US007284841B2

(12) United States Patent
Imai et al.

(10) Patent No.: US 7,284,841 B2
(45) Date of Patent: Oct. 23, 2007

(54) INK-JET RECORDING HEAD AND INK-JET RECORDING APPARATUS

(75) Inventors: Koji Imai, Inuyama (JP); Atsushi Ito, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 224 days.

(21) Appl. No.: 11/003,568

(22) Filed: Dec. 3, 2004

(65) Prior Publication Data

US 2005/0179747 A1 Aug. 18, 2005

(30) Foreign Application Priority Data

Dec. 4, 2003 (JP) ..... 2003-405971

(51) Int. Cl.
*B41J 2/14* (2006.01)
*B41J 2/045* (2006.01)

(52) U.S. Cl. ..... 347/71; 347/50

(58) Field of Classification Search ..... 347/50, 347/68–72

See application file for complete search history.

(56) References Cited

U.S. PATENT DOCUMENTS 5,265,315 A * 11/1993 Hoisington et al. ..... 29/25.35
6,715,862 B2 4/2004 Takagi et al.
7,073,894 B2 * 7/2006 Isono et al. ..... 347/68
2003/0063449 A1 4/2003 Suzuki et al.
2003/0112298 A1 * 6/2003 Sato et al. ..... 347/68
2004/0125177 A1 7/2004 Sakaida et al.

FOREIGN PATENT DOCUMENTS

JP 11-147311 6/1999
JP 2003-159795 6/2003

* cited by examiner

*Primary Examiner*—Stephen Meier
*Assistant Examiner*—Geoffrey S. Mruk
(74) *Attorney, Agent, or Firm*—Reed Smith LLP

(57) ABSTRACT

A common joining electrode and arrays of island-shaped individual joining electrodes are formed on a substrate of a flexible flat cable, which is connected to a recording head. The common joining electrode extends in the X direction along the periphery of the cable board. The individual joining electrodes are arranged in a staggered manner in a region surrounded by the common joining electrode. The wiring of the individual joining electrodes is patterned so that the gap between the common joining electrode and a wiring connected a nearest individual joining electrode to the common joining electrode is larger than the gap between the common joining electrode and the nearest individual joining electrode. In locations where wirings are closed to one another, it is possible to realize a fine wiring density without excessively narrowing the gaps between adjoining wirings and between the wirings and the side edges of the common joining electrode.

9 Claims, 16 Drawing Sheets

INK-JET RECORDING HEAD AND INK-JET RECORDING APPARATUS

BACKGROUND OF THE INVENTION

1. Field of the Invention

The present invention relates to an ink-jet recording head, and more particularly to an ink-jet recording head and an ink-jet recording apparatus which have a wiring pattern formed on a wiring board for supplying electric power to an actuator.

2. Description of the Related Art

As disclosed in the Japanese Patent Application Laid-open No. 2003-159795, an on-demand type ink-jet recording head of the conventional art includes a cavity unit and a piezoelectric actuator. The cavity unit is formed by laminating a plurality of plates and has a plurality of pressure chambers arranged in two rows or arrays. The piezoelectric actuator is joined to the cavity unit and has active portions (energy generating devices), each of which is associated with one of the pressure chambers. The piezoelectric actuator also has surface electrodes formed on its top surface thereof along both side edges in a longitudinal direction thereof. Each of the surface electrodes is associated with one of the active portions of the piezoelectric actuator to apply voltage to the active portions. The joining terminals (joining electrodes) on a flexible flat cable for transmitting control signals from an external source are overlapped with and are joined to the surface electrodes of the piezoelectric actuator.

The flexible flat cable extends in an extending direction of the piezoelectric actuator and has a large number of wirings connected to the two rows of joining electrodes (joining terminal portions). The wirings are formed on a narrow portion (width in a direction perpendicular to the longitudinal direction) of the flexible flat cable and are extended outwardly. Common joining electrodes are arranged at the outer ends of the wirings at the rows of joining electrodes. The wirings extending from the individual joining electrodes, each of which is connected to one of the active portions, pass between the two common joining electrodes in the width direction of the flexible flat cable. As a result, the width of the wirings including the common wiring in the flexible flat cable becomes extremely fine, and that the gaps therebetween become extremely narrow. Particularly, with the recent widespread use of color recording and high-speed recording, recording heads are formed with four to six rows of nozzles. Accordingly, in proportion to the increase in the number of nozzles and the number of joining electrodes, the distance (gap) between wirings, and the distance between the wirings and the common joining electrodes (joining terminals) are becoming narrower. This causes a problem of an increase in mutual inductance generated between adjoining wirings thereby degrading recording performance.

Therefore, as disclosed in Japanese Patent Application Laid-open No. 11-147311, it was conceived to realize a high integration of wirings by forming a flexible circuit board with a plurality of laminated substrate layers having wirings on one side, forming an opening in at least one of the substrate layers, exposing the wirings on the substrate layers that are formed on the backside via the opening to form joining electrodes, and joining these joining electrodes to surface electrodes for individual electrodes.

The inventor of the present invention disclosed an ink-jet recording head having a plurality of nozzle rows in U.S. Pat. No. 6,715,862 and U.S. publication No. 2004-0125177A1, which disclose extending a wiring board which supplies electricity to discharging energy generating means, each of which is associated with a nozzle, in a direction perpendicular to the nozzle rows, and extending wiring from individual joining electrodes, each of which is connected to one of the energy generating means, in a direction perpendicular to the nozzle rows. This results in the common joining electrodes extending along the side edges of the wiring board to mutually connect the ends of the plurality of rows of energy generating means. The wirings that extend from the individual joining electrodes in one row are bent to pass between the individual joining electrodes in another row.

The inventor discovered that in such wirings extending from a part of the individual joining electrodes need to pass between the individual joining electrodes in another row and the common joining electrodes, so that the space between the wirings and the common joining electrodes is extremely narrow, resulting in increased mutual inductance as stated above.

SUMMARY OF THE INVENTION

An object of the present invention is to solve the inconvenience in a case where the wirings extending from individual joining electrodes of one array pass between the individual joining electrodes of another array and common joining electrodes. Particularly, the object of the present invention is to provide an ink-jet recording head having a flexible cable which includes a large number of joining electrodes, wirings therefor and common joining electrodes, and which is capable of reducing mutual inductance, and to provide a recording apparatus equipped with such an ink-jet recording head.

According to a first aspect of the present invention, there is provided a head for ink-jet recording comprising:

a plurality of nozzle arrays each of which is arranged along a first direction and has a plurality of nozzles;

a plurality of pressure chambers corresponding to the nozzles respectively;

an actuator having a plurality of energy generating devices each of which selectively provides a discharge energy to an ink contained in each of the pressure chambers; and a wiring substrate having wirings each of which feeds electricity to each of the energy generating devices;

wherein a plurality of arrays of individual surface electrodes and a common surface electrode are provided in a form of plane on the actuator, the plurality of arrays of individual surface electrodes being provided to correspond to the nozzle arrays respectively, each of the arrays having the individual surface electrodes connected to the energy generating devices respectively and arranged in a staggered manner along the first direction, and the common surface electrode being commonly connected to the plurality of energy generating devices;

wherein a plurality of arrays of individual joining electrodes and a common joining electrode are formed in the wiring substrate, the plurality of arrays of individual joining electrodes being provided to correspond to the plurality of individual surface electrodes of the actuator respectively, each of the arrays of individual joining electrodes having a plurality of individual joining electrodes arranged in a staggered manner along the first direction, each of the plurality of individual joining electrodes being joined to an associated individual surface electrode of the individual surface electrodes, the common joining electrode being joined to the common surface electrode at a position opposed to the common surface electrode;

wherein the common joining electrode of the wiring substrate is formed in a band-like manner and extends in a direction substantially perpendicular to a direction of the arrays of individual surface electrodes;

wherein the wirings connected to the individual joining electrodes respectively extend substantially parallel to a side edge of the common joining electrode; and wherein a wiring of the wirings of the wiring substrate is connected to an individual joining electrode which belongs to the individual joining electrodes of the wiring substrate and is positioned in a nearest array to the side edge of the common joining electrode among the arrays of individual surface electrodes, and the wiring is formed so that: the wiring passes between the side edge and another individual joining electrode which is located in another array from the nearest array and is located at a position farther from the side edge than the individual joining electrode; and a gap between the wiring and the side edge is substantially equal to or greater than a gap between the individual joining electrode and the side edge.

According to the present invention, even when the individual joining electrodes are arranged in a plurality of arrays and a wiring from an individual joining electrode arranged at a portion nearest to the side edge of the common electrode passes in one array passes through a gap between the side edge and an individual joining electrode arranged in another array at an edge portion of another array which is a position far from the side edge, the gap between the this wiring and the side edge of the common joining electrode does not become narrower more than necessary. Accordingly, since the mutual inductance occurring between the side edge and the wiring adjacent thereto is not increased, the recording performance does not deteriorate.

In the present invention, when a number of arrays of the plurality of arrays of individual joining electrodes is not less than 3, and a minimum value of a distance between the individual joining electrodes in the first direction is L, a spacing between an individual joining electrode of a first array of the arrays of individual joining electrodes and an individual joining electrode of a second array, which is adjacent to the individual joining electrode of the first array in an extending direction of a wiring connected to the individual joining electrode of the first array, may be distanced by a length of not less than 2L in the first direction so that a wiring, which is connected to an individual joining electrode of other array, passes through the spacing. Even when a dimension of a gap between an individual joining electrode of an odd number array and an individual joining electrode of an even number array which are adjacent to each other in X direction, there is a gap in Y direction having a length of not less than 2L. Accordingly, it is possible to arrange a plurality of wirings so that the wirings are not located too near to each other between the individual joining electrodes adjacent to one another.

In the present invention, when a number of arrays of the individual joining electrodes is not less than 3, and a minimum value of a distance between the individual joining electrodes in the first direction is L, a spacing between an individual joining electrode of a first array of the arrays of individual joining electrodes and an individual joining electrode of a second array adjacent to the individual joining electrode of the first array in an extending direction of a wiring, which is connected to the individual joining electrode of the first array, may have a length of not less than 2L in the first direction; and an individual joining electrode of a third array, which is adjacent to the individual joining electrode of the second array in an extending direction of a wiring connected to the individual joining electrode of the second array, may be arranged in the first direction between the individual joining electrode of the first array and the individual joining electrode of the second array. By arranging the wiring in this manner, it is possible arrange wirings, in a portion in which wirings are close to each other (portion with high wiring density), without making the gap dimension between the wirings adjacent to one another too dense or without making the gap between the wiring and the side edge of the common joining electrode too dense, and it is possible to form the wiring with fine density.

In the present invention, the wiring board may be a flexible flat cable extending in a direction substantially perpendicular to the nozzle arrays, and the common joining electrode may be formed along an edge portion of the flexible flat cable extending along a direction substantially perpendicular to the first direction. In this case, by making the wiring substrate a flexible flat cable, it is possible to form a thin-type wiring board. On one surface of the flexible flat cable, there is an area or region in which arrays of individual joining electrodes exist sparsely in a staggered manner, and the common joining electrode is formed outside this area on the one side of the flexible flat cable in a band-like manner in a direction substantially perpendicular to the arrays (X direction). Accordingly, it is possible to ensure that a plurality of common surface electrodes and a plurality of individual joining electrodes formed on a broad-width surface of the actuator are joined with one another. Thus, it is possible to prevent the joining from exfoliating even when the flexible flat cable expands or contracts in the extending direction of the band-like common joining electrode due to the change in temperature or the like, thereby enhancing the reliability. Since the individual surface electrodes are formed on the broad-width surface of the flexible flat cable at portions nearer to the inner circumference of the broad-width surface of the actuator, it is possible to realize a high-density arrangement of a large number of the corresponding individual joining electrodes and the wirings connected thereto by utilizing the large dimension of the broad-width surface of the flexible flat cable.

In the present invention, the flexible flat cable may have an intermediate portion in an extending direction thereof, an integrated circuit for driving the energy generating devices may be mounted on the intermediate portion, and other end of each of the wirings may be connected to the integrated circuit. In this case, an integrated circuit is mounted on the intermediate portion which is disposed in the longitudinal direction (extending direction) of the flexible flat cable, and the other ends of the wirings are connected to the integrated circuit. Accordingly, it is possible to simplify the constitution or construction and making the wiring operation more easily compared with a case in which the integrated circuit is mounted in a portion other than this intermediate portion.

In this case, the flexible flat cable may be provided with a substrate which has the common joining electrode, the individual joining electrodes and the wirings on one surface thereof; and the common joining electrode and the individual joining electrodes may be exposed via opening portions formed in the substrate respectively. Accordingly, the laminated or stacked structure of the flexible flat cable becomes simple and easy, and it is possible to realize an easy alignment and joining of the opening portions in one surface of the flexible flat cable and the surface electrodes formed on the broad-width surface of the actuator.

In this case, bump electrodes may be disposed on surfaces of the common joining electrode and the individual joining electrodes which are exposed in the opening portions respectively to laminate and join the common surface electrode and the individual surface electrodes with each other. Accordingly, it is possible to join the flexible flat cable and the actuator via the bump electrodes, thereby making the joining operation easier and further enhancing the joining strength.

According to a second aspect of the present invention, there is provided a head for ink-jet recording comprising:

a plurality of nozzle arrays arranged along a first direction, each of the nozzle arrays having a plurality of nozzles;

a plurality of pressure chambers corresponding to and communicating with the plurality of nozzles respectively;

actuators which are provided for the plurality of pressure chambers respectively and which selectively deform the pressure chambers in order to jet an ink from the nozzles;

a wiring substrate having wirings electrically connected to the actuators;

a plurality of arrays of individual electrodes which are arranged on the wiring substrate and correspond to the plurality of nozzle arrays respectively, each of the arrays of individual electrodes having a plurality of individual electrodes which are arranged along the first direction in a staggered manner and which feed electricity to portions of the actuators corresponding to the pressure chambers; and a common electrode arranged on the wiring substrate and extends in a second direction which is substantially perpendicular to the first direction;

wherein a spacing between the common electrode and a wiring of the wirings which is connected to a nearest individual electrode nearest to the common electrode among the plurality of individual electrodes of the wiring substrate is greater than a spacing between the common electrode and the nearest individual electrode.

According to a third aspect of the present invention, there is provided an ink-jet recording apparatus comprising:

a head for ink-jet recording;

an ink tank which supplies an ink to the head for ink-jet recording, wherein the head for ink-jet recording includes:

a plurality of nozzle arrays arranged along a first direction, each of the nozzle arrays having a plurality of nozzles;

a plurality of pressure chambers corresponding to and communicating with the nozzles respectively;

actuators which are provided for the pressure chambers respectively and which selectively deform the pressure chambers in order to jet an ink from the nozzles, a wiring substrate having wirings electrically connected to the actuators respectively;

a plurality of arrays of individual electrodes which are arranged on the wiring substrate and correspond to the nozzle arrays respectively, each of the arrays of individual electrodes having a plurality of individual electrodes which are arranged along the first direction in a staggered manner and which feed electricity to portions of the actuators corresponding to the pressure chambers; and a common electrode arranged on the wiring substrate and extends in a second direction substantially perpendicular to the first direction;

wherein a spacing between the common electrode and a wiring of the wirings connected to a nearest individual electrode nearest to the common electrode among the plurality of individual electrodes of the wiring substrate is greater than a spacing between the common electrode and the nearest individual electrode.

PREFERRED EMBODIMENTS OF THE INVENTION

Figure 16:
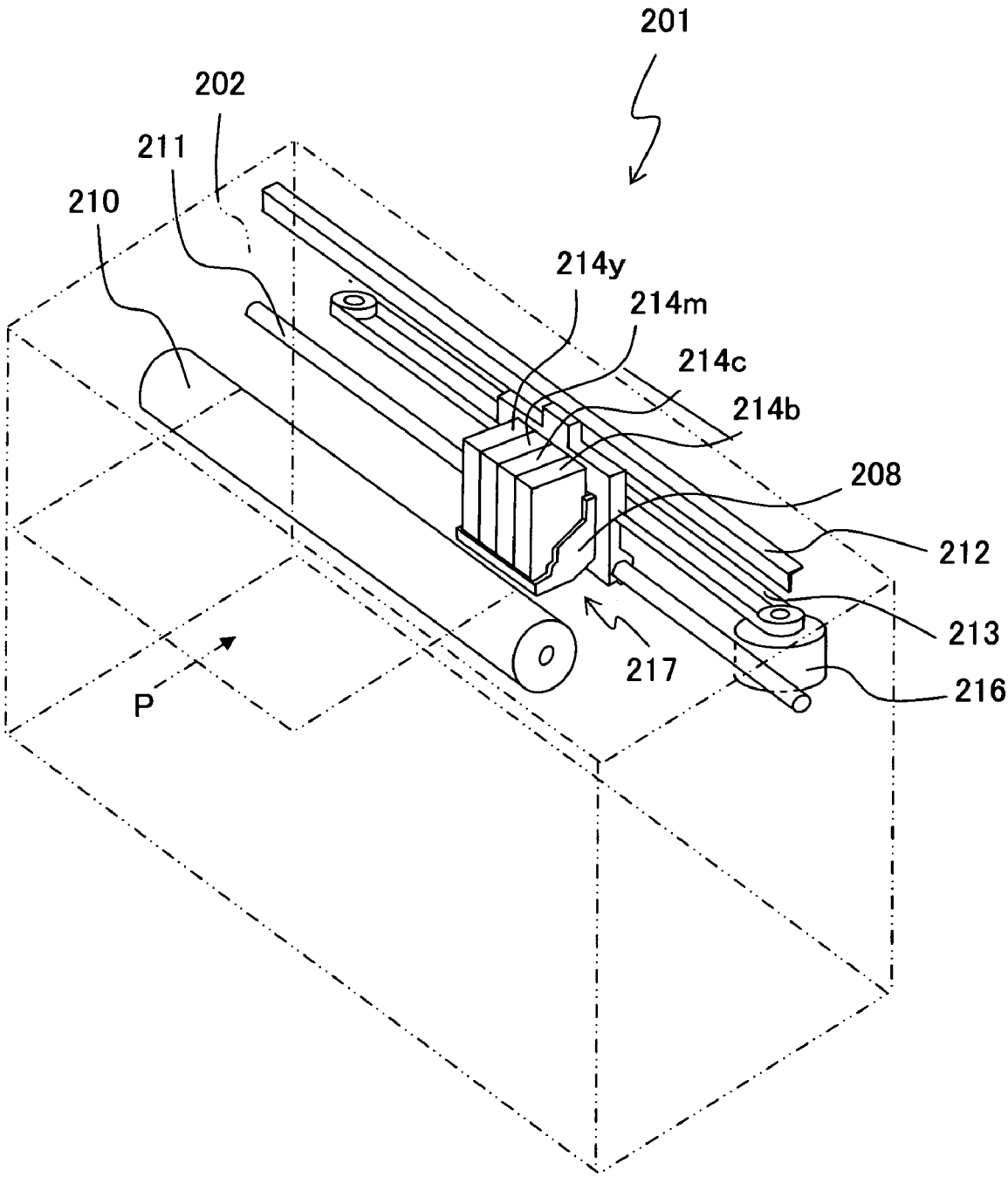
FIG. 16 is a perspective view of a color ink-jet printer having an ink-jet recording head prepared in an example of the present invention.

The following is an explanation of the best mode of the present invention with reference to the drawings. Preferred embodiments of an ink-jet recording head according to the present invention and an ink-jet printer as an ink-jet recording apparatus according to the invention will be described with reference to the drawings. As shown in FIG. 16, an ink-jet printer 201 has a carriage 208 inside its frame 202. The carriage 208 is slidably supported on a guide rod 211 and a guide member 212. The carriage 208 is fixed to a belt 213 and reciprocates by a CR motor 216. The carriage 208 is fitted with a recording head 217 having a head unit, which is described later on, for print recording. The recording head 217 is an ink-jet type which performs recording by ejecting four colors (cyan c, magenta m, yellow y, and black b) of ink droplets onto recording paper P which is a recording medium. The recording head 217 has rows or arrays of nozzles, which are described later on, formed on its side adjacent to the recording paper P to eject the colors of ink.

Four ink cartridges 214*y*, 214*m*, 214*c*, and 214*b* are detachably mounted on the recording head 217 and supply the respective colors of ink to the rows of nozzles. The ink-jet printer 201 of this embodiment has a platen roller 210 for feeding the recording paper P. The platen roller 210 is positioned opposite the recording head 217. The platen roller 210 is rotated by driving an LF motor (not shown) to feed the recording paper P in a direction (indicated by an arrow in FIG. 16) that is perpendicular to the direction of movement of the carriage 208.

Figure 1:
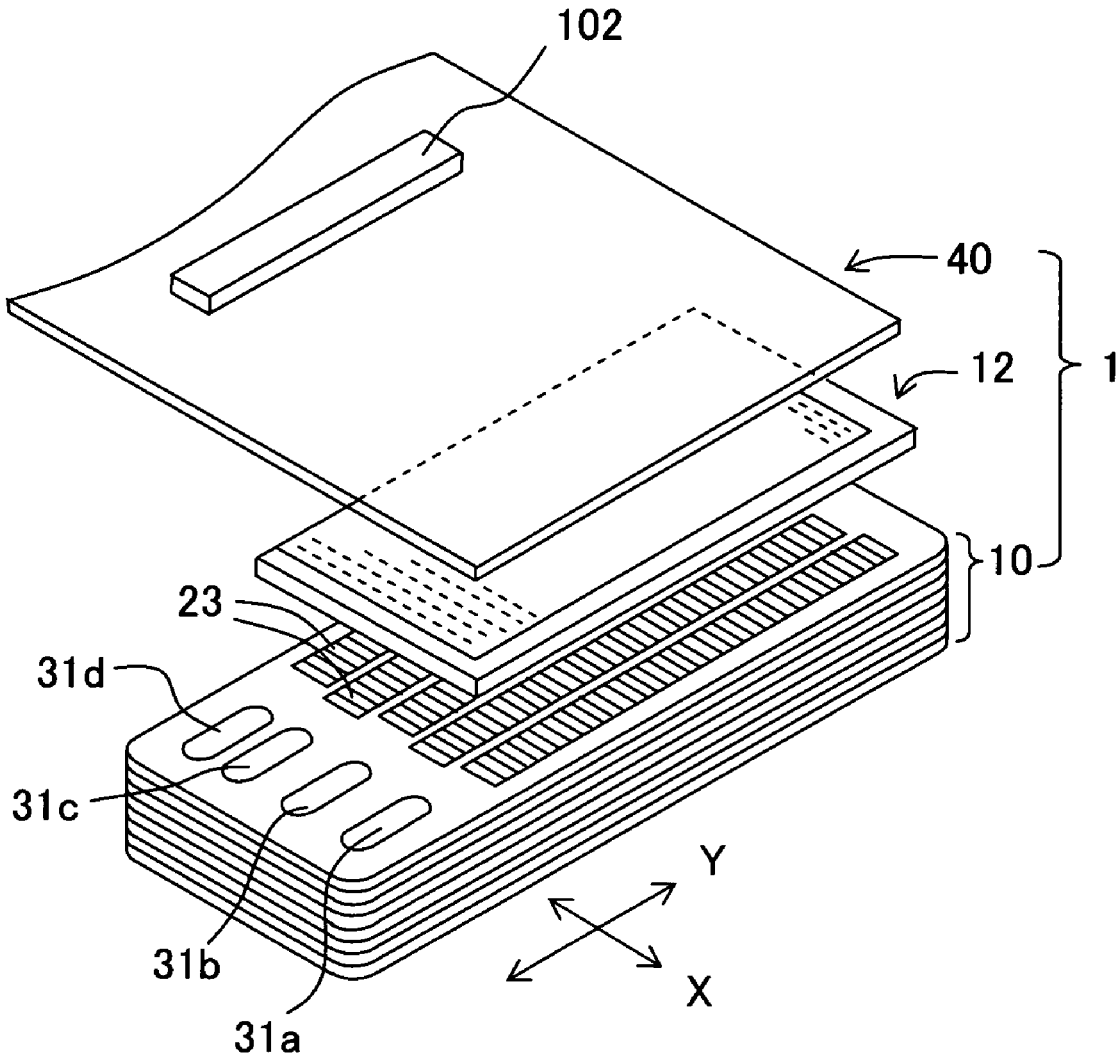
FIG. 1 is an exploded perspective view of the cavity unit, piezoelectric actuator and flat cable of a piezoelectric head for ink-jet recording according to a first embodiment of the present invention.
Figure 2:
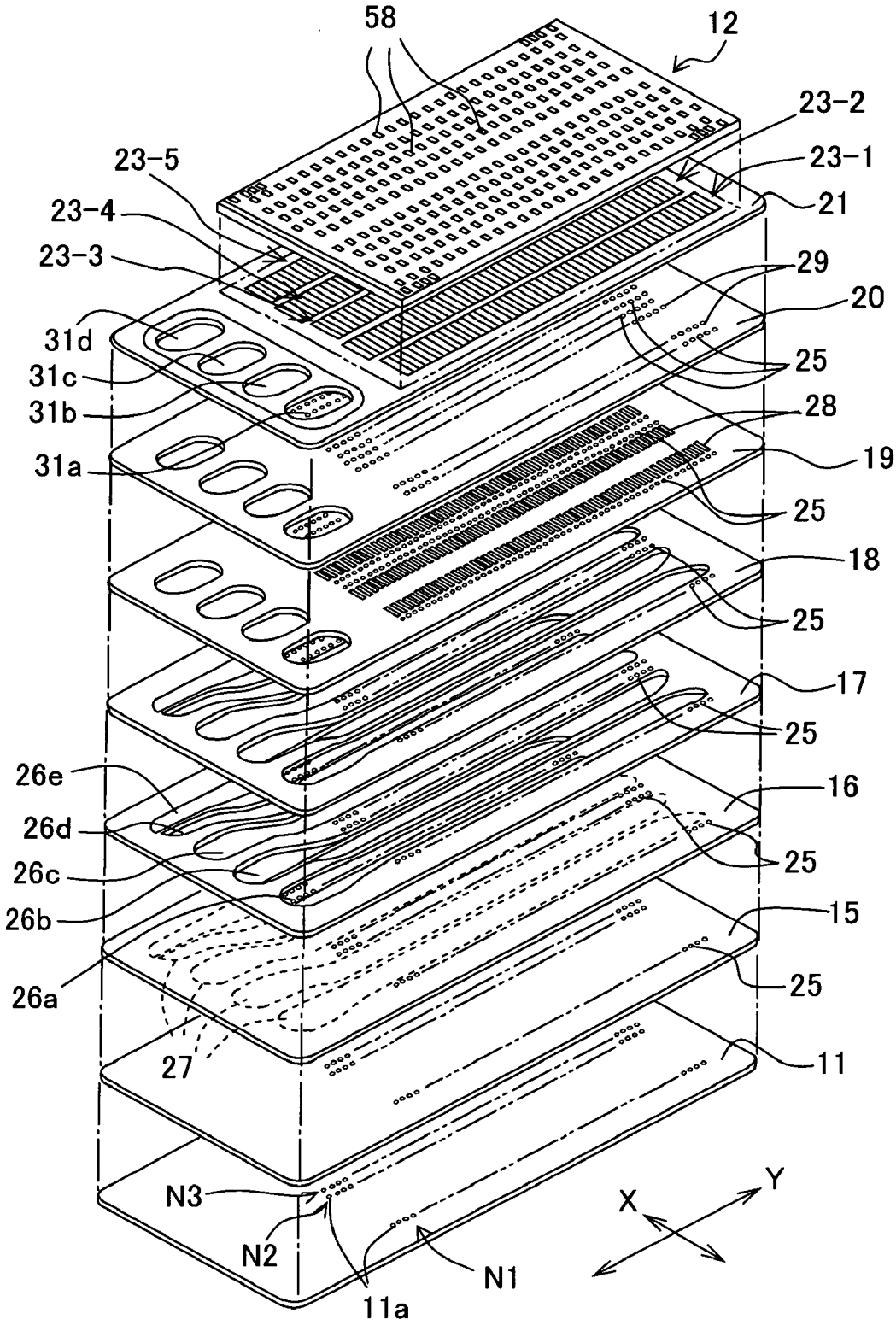
FIG. 2 is an exploded perspective view of the cavity unit.
Figure 3:
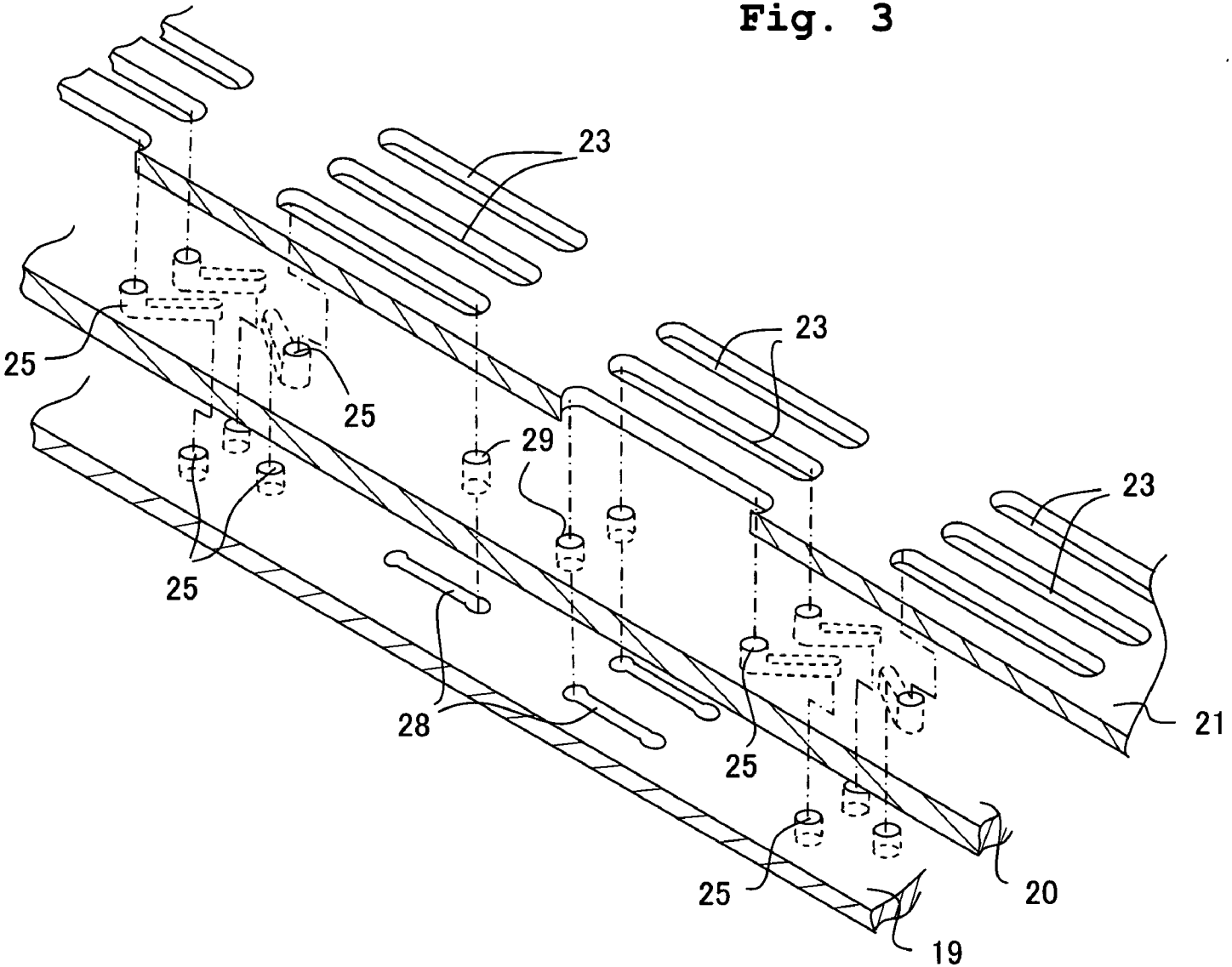
FIG. 3 is an exploded partial perspective view of the cavity unit.

Ahead unit which constitutes a part of the recording head 217 will be described with reference to FIGS. 1 and 2. As shown in FIG. 2, the head unit 1 includes a cavity unit 10, a plate-shaped piezoelectric actuator 12 and a flexible flat cable 40 as an example of wiring board. The cavity unit 10 has a plurality of nozzles 11*a* (see FIG. 2) arranged in rows in Y direction (first direction) on its front surface (the bottom surface in FIG. 2). The rows (five rows in the embodiment) of nozzles are arranged at suitable intervals or spacings in X direction. The piezoelectric actuator 12 lies on the top surface of the cavity unit 10 and is bonded thereto by an adhesive or an adhesive sheet. The flexible flat cable 40 is overlapped with and joined to the back (top) surface of the piezoelectric actuator 12 for electric connection to an external device.

The cavity unit 10 is constituted as shown in FIG. 2. Specifically, the cavity unit 10 includes a total of eight flat plates, which are a nozzle plate 11, a cover plate 15, a damper plate 16, two manifold plates 17 and 18, two spacer plates 19 and 20, and a base plate 21, laminated in order from the bottom layer and joined by an adhesive. The base plate 21 has pressure chambers 23. The nozzle plate 11 is made of synthetic resin, and the other plates 15 through 21 are made of 42% nickel alloy steel. The thickness of each of these plates is approximately 15 to 150 μm.

The nozzle plate 11 has a large number of nozzles 11*a* for ejecting ink. The nozzles 11*a* have a minute diameter (approximately 25 μm in this embodiment). The nozzles 11*a* are arranged in a staggered manner in a first direction at the nozzle plate 11 (longitudinal direction of the cavity unit 10; in the Y direction and the sub scanning direction in FIG. 2). Nozzle arrays N are arranged in five arrays (individually assigned reference numerals N1 to N5, although N4 and N5 are not shown) at suitable intervals or spacings in the X direction (the main scanning direction). In this embodiment, the length of each nozzle array N of the first array to the fifth array is 1 inch, and the number of nozzles 11*a* in each array is 75. In other words, the array density is 75 (dpi: dots per inch).

In FIG. 2, taking the nozzle arrays N1 to N5 (N4 and N5 are not shown) in order from the right, the nozzle array N1 is used for cyan ink (C); the nozzle array N2 is used for yellow ink (Y); the nozzle array N3 is used for magenta ink (M); and the nozzle arrays N4 and N5 are used for black ink (BK).

The upper and lower manifold plates 17 and 18 have ink paths formed through the thickness thereof and extending in the Y direction. Each ink path of each of the manifold plates 17 and 18 is associated with one of the nozzle arrays N1 to N5. With the manifold plates 17 and 18 stacked between the first spacer plate 19 on the upper side and the damper plate 16 on the lower side, the ink paths form five arrays of common ink chambers (manifold chamber) 26. In FIG. 2, taking the common ink chambers 26 in the order of 26*a*, 26*b*, 26*c*, 26*d* and 26*e* from the right side, the common ink chamber 26*a* is for cyan ink (C); the common ink chamber 26*b* is for yellow ink (Y); the common ink chamber 26*c* is for magenta ink (M); and a pair of the common ink chambers 26*d* and 26*e* is for black ink (B).

The base plate 21 has four ink supply ports formed through one end thereof in the Y direction at suitable spacings in the X direction. In FIG. 2, assigning the ink supply ports the reference numerals 31*a*, 31*b*, 31*c* and 31*d* from the right side, the ink supply ports 31*a*, 31*b*, 31*c* are associated with the common ink chambers 26*a*, 26*b* and 26*c* respectively from the right side. The fourth ink supply port 31*d* from the right is associated with the adjoining ends of the two common ink chambers 26*d* and 26*e*. As shown in FIG. 2, each of the spacer plates 20 and 19 has ink supply paths 32 formed through one end thereof. The ink supply paths 32 are aligned to communicate with the ink supply ports 31*a*, 31*b* and 31*c*. Each ink supply path 32 of each of the spacer plates 20 and 19 communicates with one end of the associated common ink chamber 26*a*, 26*b* or 26*c*.

The damper plate 16 is bonded to the bottom surface of the lower manifold plate 17 and has damper chambers 27 formed on the lower side surface of the damper plate 16. The damper chambers 27 are grooves formed to be open only on the bottom surface of the damper plate 16. Each damper chamber 27 extends along one of the common ink chambers 26 in the Y direction. The damper chambers 27 are completely closed by being covered with the cover plate 15 on the bottom surface of the damper plate 16.

With this constitution, the regressive components of the pressure waves which act on the pressure chambers 23 with the drive of the piezoelectric actuator 12 are absorbed by the vibration of the thin damper plate 16. This prevents the generation of crosstalk. The regressive components are propagated toward the common ink chambers 26 by the ink.

The first spacer plate 19 has throttles 28 in the form of grooves which are slightly long in the X direction and narrow in the Y direction. Each throttle 28 is associated with one of the nozzles 11*a* of the nozzle arrays N1 to N5. One end of each throttle 28 communicates with the associated common ink chamber 26*a*, 26*b*, 26*c*, 26*d* or 26*e* in the manifold plate 18. As described later on, the other end of each throttle 28 communicates with one of communication holes 29 formed vertically through the second spacer plate 20 on the upper surface.

The cover plate 15, damper plate 16, two manifold plates 17 and 18, and first and second spacer plates 19 and 20 have communication paths 25 formed vertically therethrough, which communicate with the nozzles 11*a* in each of the nozzle arrays N1 through N5. The communication paths 25 are formed so as not to overlap vertically with the common ink chambers 26 and damper chambers 27.

The base plate 21 has narrow-width pressure chambers 23 (in arrays 23-1, 23-2, 23-3, 23-4, and 23-5) which are formed through the thickness of the base plate and which extend in the X direction for each of nozzle arrays N. The pressure chambers 23 are equal in number to the nozzles 11*a*. One end in the longitudinal direction (in the X direction) of each pressure chamber 23 communicates with the other end of one of the throttles 28 in the first spacer plate 19 via one of the communication holes 29 in the second spacer plate 20. The other end in the longitudinal direction of each pressure chamber 23 communicates with one of the communication paths 25 in the second spacer plate 20. The pressure chambers 23 in each array are offset at half a pitch in the Y direction with respect to those in the adjoining array or arrays so that the pressure chambers 23 are arranged in a so-called staggered manner.

Through this constitution, the ink which flows from the ink supply ports 31*a* to 31*d* into the common ink paths 26 passes through the throttles 28 and the communication holes 29 to be distributed to the pressure chambers 23, then the ink travels from the pressure chambers 23 through the communication paths 25 and arrives at the nozzles 11*a*, each of which is associated with one of the pressure chambers 23.

The structure of the piezoelectric actuator 12 will be described below. As described in detail later on, the piezoelectric actuator 12 includes, as active portions (energy generating means), individual electrodes 36 sandwiching piezoelectric sheets therebetween in a stacking direction thereof, and the piezoelectric sheets which are disposed between common electrodes and the individual electrodes 36 and which are opposed to each other in the stacking direction of these electrodes. Application of voltage between any individual electrodes 36 and common electrodes 37 generates strain, in the stacking direction by the piezoelectric longitudinal effect, in the active portions of the piezoelectric sheets associated with these individual electrodes 36. The active portions (energy generating means) are equal in number to the pressure chambers 23 and formed in arrays, each of which is formed at a position corresponding to one of the arrays of pressure chambers 23.

Specifically, the active portions are aligned in the direction of the arrays of nozzles 11*a* (pressure chambers 23) in the first direction (Y direction) and arranged in the second direction (X direction) with the same number as the number of nozzle arrays (5). The active portions are formed to extend in the longitudinal direction of the pressure chambers 23 in the second direction (the X direction, direction of width of the cavity unit 10). The arrangement pitch (P) of the adjoining active portions is the same as the arrangement of the pressure chambers 23 that is described later on. These active portion are also arranged in a staggered manner.

Figure 4:
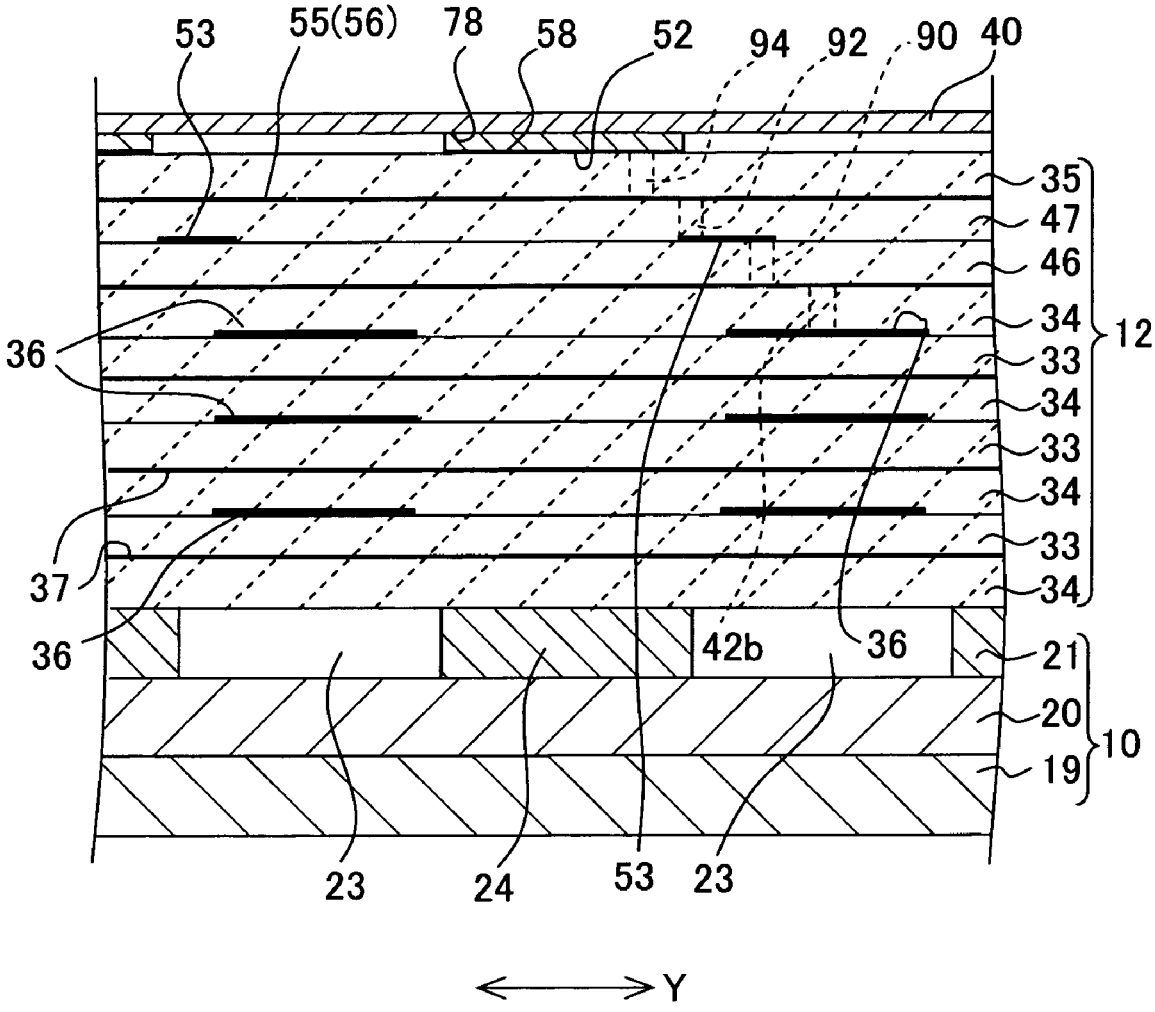
FIG. 4 is an enlarged partial sectional view of the piezoelectric actuator.

As shown in FIG. 4, the piezoelectric actuator 12 is formed of a plurality of (seven in this embodiment) alternately stacked piezoelectric sheets 33 and 34, a restricting layer, and a top sheet 35 as a surface sheet. The piezoelectric sheets 33 and 34 are made of piezoelectric ceramic plates, each of which has a thickness of approximately 30 μm. The restricting layer is formed of two sheets 46 and 47, and is stacked on the uppermost sheet of the stacked piezoelectric sheets 33 and 34. The top sheet 35 is stacked on the top surface of the restricting layer. The restricting layer sheets and the top sheet may be made of piezoelectric ceramic plates or other electrical insulating materials.

As shown in FIG. 4, patterns of narrow-width individual electrodes 36 are formed on the upper surfaces (flat plate surfaces) of the even numbered piezoelectric sheets 33 which is counted upward from the lowest piezoelectric sheet 34, and has a common electrode 37. The patterns of the individual electrodes 36 or the like are arranged in arrays in the first direction (longitudinal direction of the piezoelectric sheets 33, in the Y direction in FIG. 2, and along the arrays of nozzles 11*a*) at positions corresponding to the pressure chambers 23 in the cavity unit 11.

Figure 7:
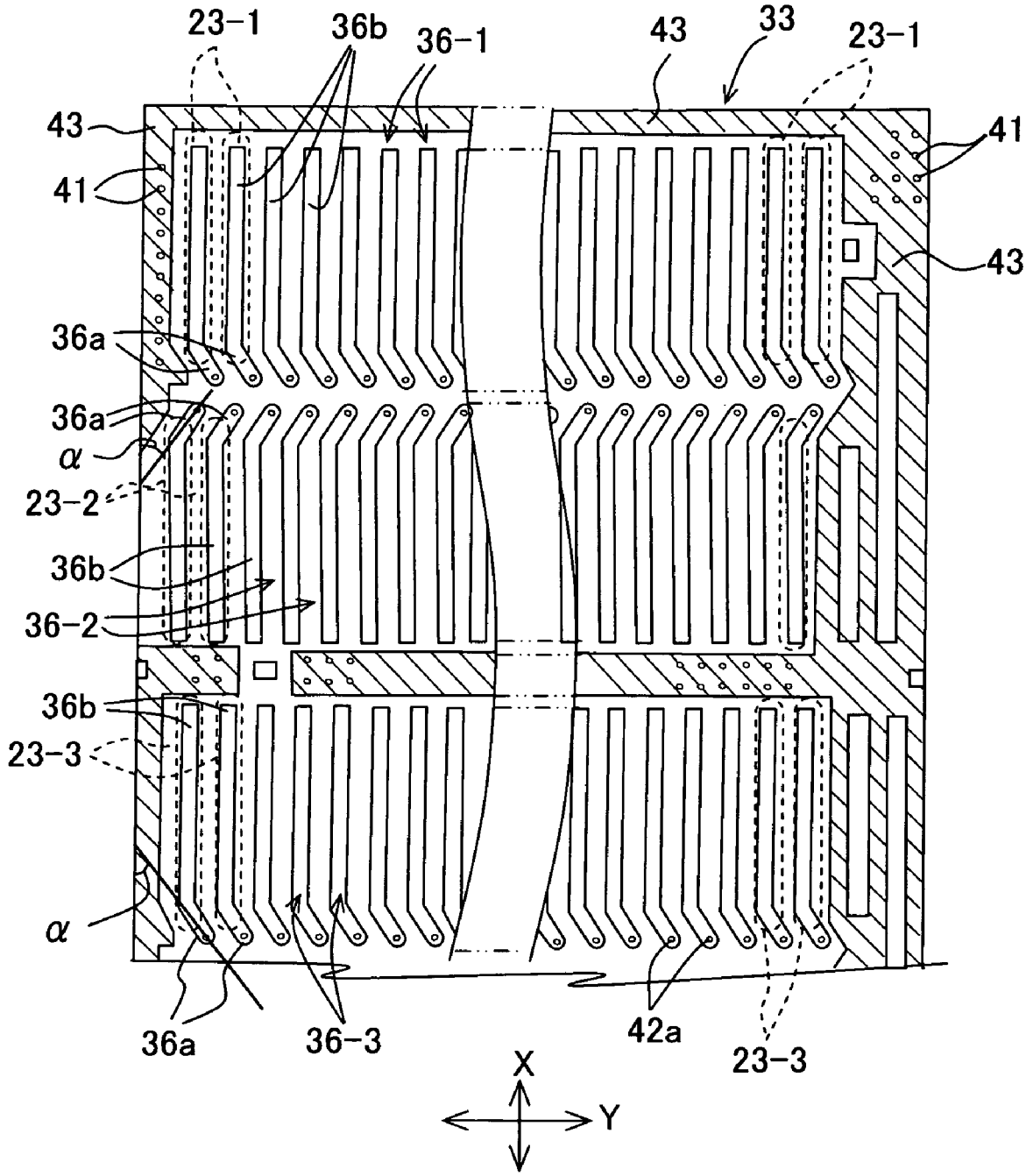
FIG. 7 is a partially cut-out, enlarged plan view of a piezoelectric sheet, showing patterns of individual electrodes etc.

FIG. 7 is a plan view of the patterns of individual electrodes 36 or the like on one of the piezoelectric sheets 33. In FIG. 7, only a portion of the piezoelectric sheet is shown. FIG. 7 shows the first array of individual electrodes 36-1, the second array of individual electrodes 36-2 and the third array of individual electrodes 36-3 for the arrays 23-1, 23-2 and 23-3 of pressure chambers, respectively. FIG. 7 does not show the fourth and fifth arrays of individual electrodes for the arrays 23-4 and 23-5 of pressure chambers, but they are substantially the same.

The patterns of individual electrodes 36-1, 36-2 and 36-3 extend in parallel to the short sides of the piezoelectric sheets 33 in the second direction (X direction) perpendicular to the first direction. In this case, the linear portions 36*b* of the individual electrodes 36-1, 36-2, 36-3 overlap with the arrays 23-1, 23-2 and 23-3 of pressure chambers (see the dotted lines in FIG. 6) with substantially the same length in a plan view. The linear portions 36*b* are formed in straight lines and has somewhat a narrower width than the pressure chambers.

Figure 5:
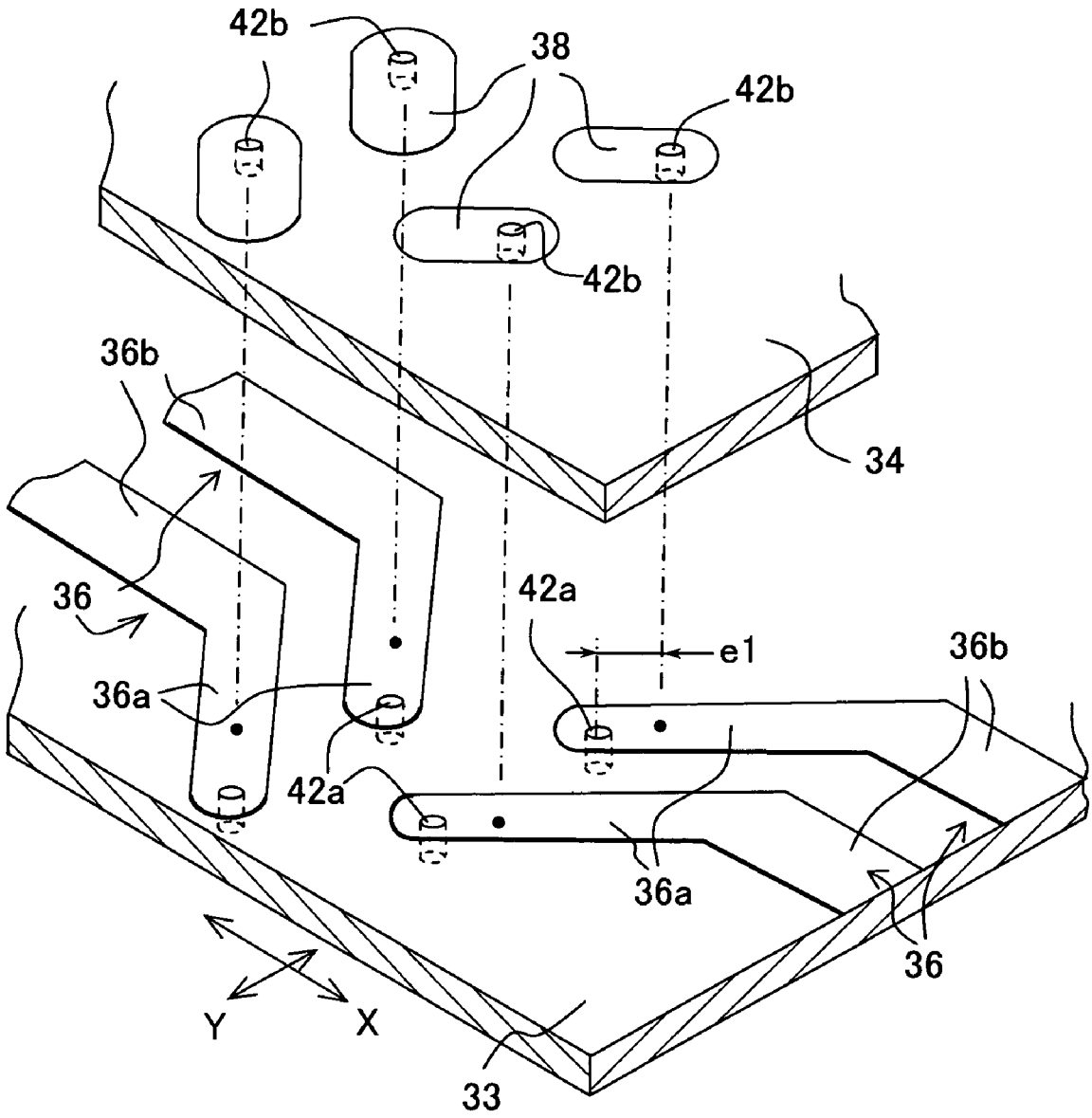
FIG. 5 is an enlarged partial perspective view showing the positions of individual electrodes, dummy electrodes and internal conducting electrodes on piezoelectric sheets.

As shown in FIG. 5, the end portion 36*a* of each of the individual electrodes 36-1 to 36-3 is bent obliquely at an angle α (an acute angle of approximately 60 degrees) to the associated linear portion 36*b* in a plan view, and extends to the outside of the associated pressure chamber.

At least a portion of the end portion 36*a* overlaps in a plan view with one of dummy individual electrodes 38 (see FIGS. 5 and 6) as first island-shaped individual conducting portions on the upper and lower adjoining piezoelectric sheets 34 and with one of first connecting patterns 53 (individually shown as reference numerals 53-1, 53-2, and 53-3; see FIG. 8) of the lower sheet 46 in the restricting layer, described later on. The end portion 36*a* is disposed at a position where it can be electrically connected to internal conducting electrodes 42*a*, 42*b*, and 90 which extend through the piezoelectric sheets 34 and the lower sheet 46, respectively (see FIGS. 5, 8 and 12).

The piezoelectric sheets 33 have dummy common electrodes 43 formed on portions thereof which overlap partially with the common electrodes 37 on the piezoelectric sheets 34 in a plan view. The overlapping portions include peripheral portions along the short and long sides of the broad-width surfaces of the piezoelectric sheets 33 and portions around the arrays of individual electrodes 36-1 and 36-2 or the like (see FIG. 7).

Figure 6:
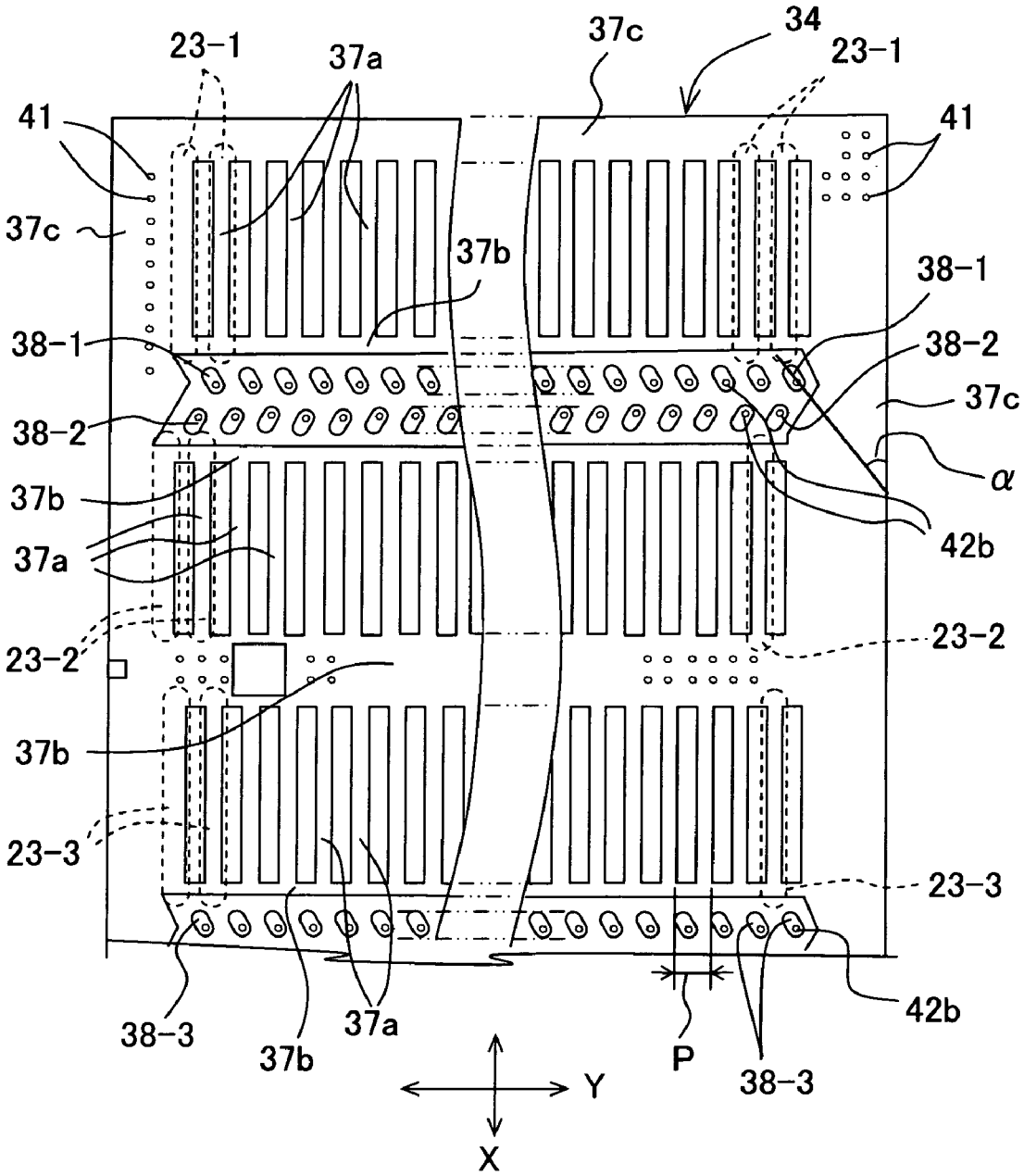
FIG. 6 is a partially cut-out, enlarged plan view of a piezoelectric sheet, showing patterns of a common electrode etc.
Figure 12:
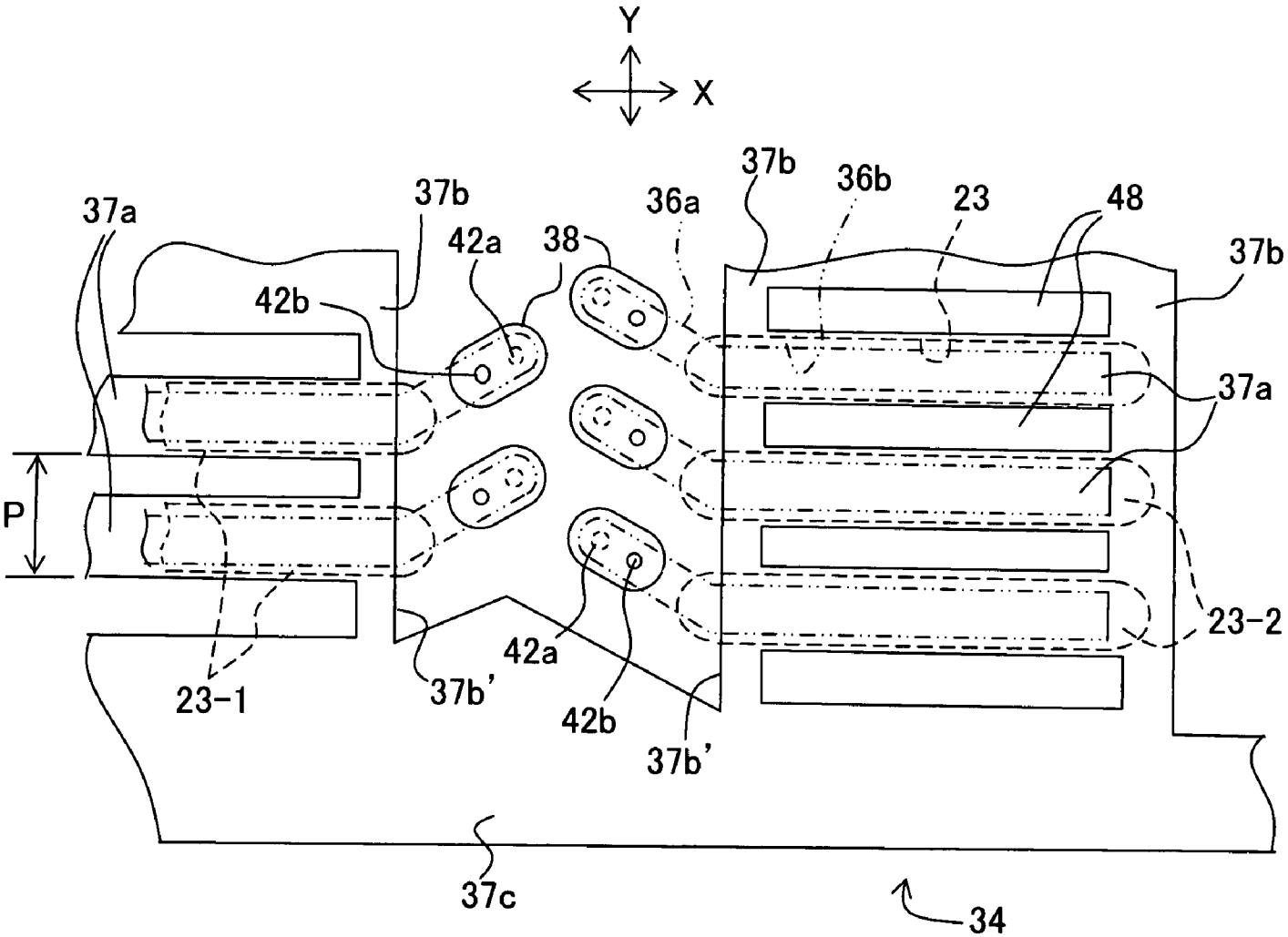
FIG. 12 is a partially cut-out, enlarged plan view of a piezoelectric sheet, showing the details of the patterns of the common electrode etc.
Figure 13:
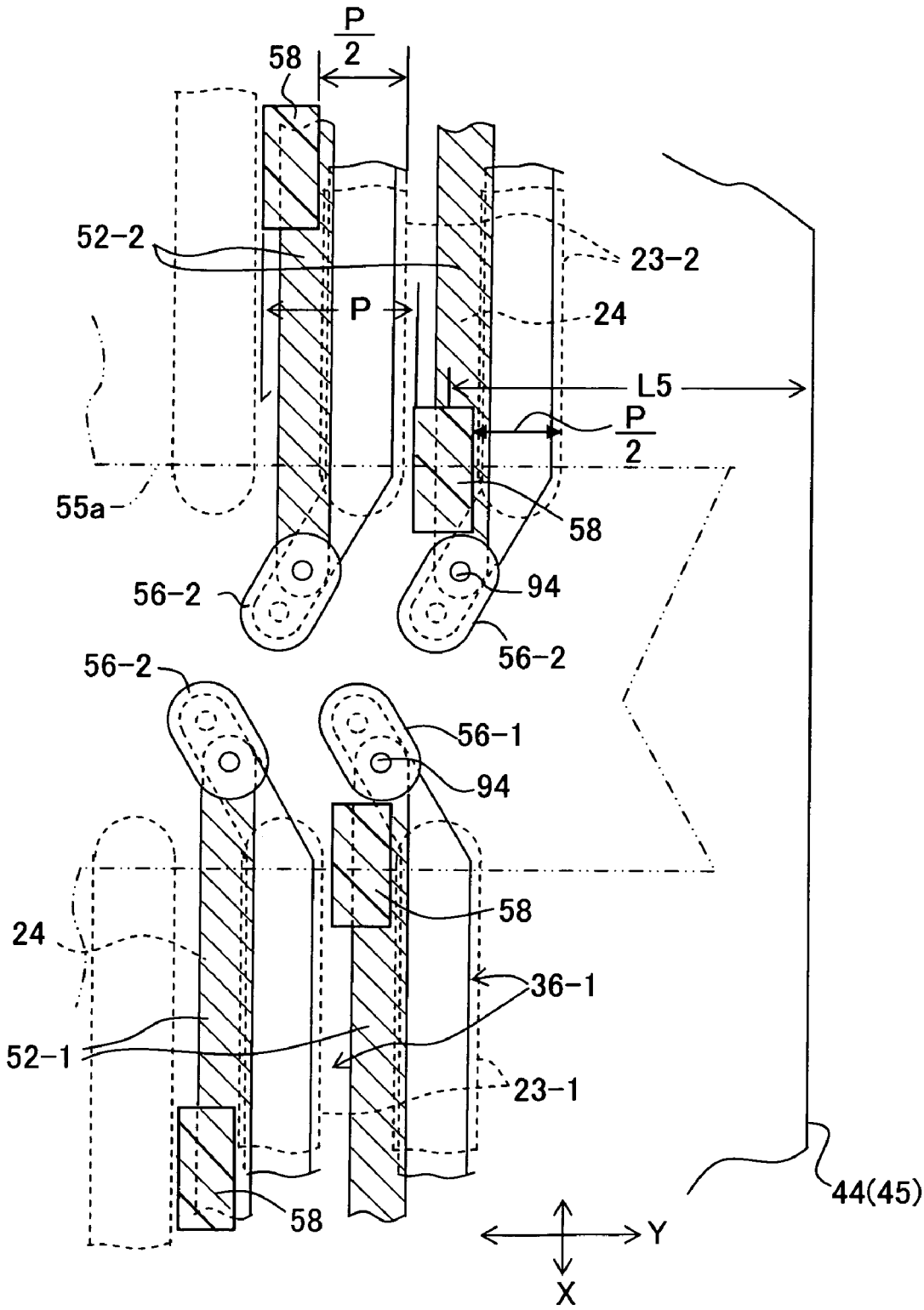
FIG. 13 is a partially cut-out, enlarged plan view showing the overlapping relationship of the individual electrodes, individual conducting layers and individual surface electrodes with respect to pressure chambers in a plan view of the top sheet.

The common electrodes 37 are formed by printing on the lowest piezoelectric sheet 34 and the odd numbered piezoelectric sheets 34 counting upward therefrom (see FIGS. 6, 12 and 13). The common electrodes 37 overlap in a plan view with the arrays of pressure chambers 23-1, 23-2 and 23-3 and the arrays of individual electrodes 36-1, 36-2 and 36-3. Each of the common electrodes 37 is formed of first electrically conducting portions 37*a* and second electrically conducting portions 37*b*. The first electrically conducting portions 37*a* extend in a longitudinal direction of the pressure chambers 23 (the linear portions 36*b* of the individual electrodes 36) (in the X direction). The second electrically conducting portions 37*b* electrically connect the ends of the first electrically conducting portions 37*a* in the first direction (Y direction), corresponding to the ends of the pressure chambers 23 in the longitudinal direction thereof. Third conducting portions (peripheral conducting portions) 37*c* are formed around the peripheral portions along the short and long sides of the broad-width surfaces of the piezoelectric sheets 34, and connected to the ends of the first and second electrically conducting portions 37*a* and 37*b*.

The patterns of common electrodes 37 will be described below in further detail in reference to FIGS. 6 and 12. These patterns are formed of first electrically conducting portions 37*a* and second electrically conducting portions 37*b*. The first electrically conducting portions 37*a* are rectangular in a plan view and substantially equal in length to the dimension of the pressure chambers 23 in the longitudinal direction thereof of the first array of pressure chambers 23-1, for example. The second electrically conducting portions 37*b* are connected to the ends of the first electrically conducting portions 37*a* over the ends of the pressure chambers 23 at positions corresponding to the longitudinal direction thereof, and extend in the direction of the arrays of pressure chambers 23 (in the Y direction). Rectangular blank spaces 48 are formed as regions surrounded by the first and second electrically conducting portions 37*a* and 37*b*, and positioned over the spacer walls 24 between the pressure chambers 23 adjoining in the first array of pressure chambers 23-1. The first electrically conducting portions 37*a*, the individual electrodes 36-1, 36-2 and 36-3, and the pressure chambers 23 are arranged at the arrangement pitch P (see FIGS. 6 and 12).

The piezoelectric sheets 34 have dummy individual electrodes 38 (shown individually as reference numerals 38-1, 38-2, and 38-3) which has a substantially elliptical shape in a plan view and which are positioned at portions corresponding to the portions between the first array and second array of pressure chambers or the like. The dummy individual electrodes 38 are arranged at regular spacings in the direction of the arrays of pressure chambers 23 and the arrays of individual electrodes 36, in the region surrounded by the long edges 37*b*' of the second electrically conducting portion 37*b* between the first array of pressure chambers 23-1 and the second array of pressure chambers 23-2. The dummy individual electrodes 38 are arranged at regular spacings so as to overlap in a plan view at least partially with the end portions 36*a*, and not the linear portions 36*b* of the individual electrodes 36. In a plan view, the elliptic dummy individual electrodes 38 also extend obliquely at the angle $\alpha$ (acute angle of approximately 60 degrees) with respect to the short sides of the piezoelectric sheets 34 in the same direction in which the end portions 36*a* of the individual electrodes 36 extend (see FIG. 6).

The dummy individual electrodes 38 are called first island-shaped individual conductors. The shortest distances between the contour edges of the pattern regions of the dummy individual electrodes 38 and the long edges 37*b*' of the second electrically conducting portions 37*b*, and the distances between the contour edges of the pattern regions of the adjoining dummy individual electrodes 38 are set to be constant.

In this way, by obliquely forming the dummy individual electrodes 38 as the first island-shaped individual conductors, it is possible to make them long, and while maintaining a constant distance between the contour edges of the adjoining pattern regions, it is possible to shorten the distance between the long edges 37*b*' of the pair of opposite second electrically conducting portions 37*b* (see FIGS. 6 and 12). The result is that, even if there is a slight error in the size of the pattern regions (area) caused by the spreading or blurring of the contours of the patterns when printing the patterns, the distance between adjoining patterns can be maintained at a predetermined distance or a longer distance than the predetermined distance. Therefore, when applying voltage to the electrodes, current does not leak between adjoining electrodes, and it is possible to reliably operate only the active portions corresponding to the predetermined pressure chambers. This achieves the result of maintaining good recording quality. As a result, it is possible to shorten the short side of the piezoelectric actuator 12 (in the X direction) so as to make the ink-jet recording head compact.

The piezoelectric sheets 34 and 33 except the lowermost piezoelectric sheet 34 have a plurality of through holes cut through their thickness at the common electrodes 37 such as the stem portions 37*a*, 37*b*, and 37*c* and the dummy common electrodes 43. The through holes are filled with conductive members (conductive paste), which form internal conducting electrodes 41 for electrically connecting a plurality of portions of the common electrodes 37 and dummy common electrodes 43 in the vertical directions. Likewise, the piezoelectric sheets 34 and 33 have a plurality of through holes cut through their thickness at the end portions 36*a* of the individual electrodes 36-1 on a plurality of piezoelectric sheets 33 and the dummy individual electrodes 38 on the piezoelectric sheets 34. The through holes are filled with conductive members (conductive paste), which form internal conducting electrodes 42*a* and 42*b* for electrically connecting the end portions 36*a* of the individual electrodes 36-1 and the dummy individual electrodes 38 in the vertical directions. The internal conducting electrodes 42*a* in the piezoelectric sheets 33 are spaced at a suitable distance e1 from the internal conducting electrodes 42*b* in the piezoelectric sheets 34 so that the electrodes 42*a* and 42*b* do not overlap vertically in a plan view (see FIGS. 5 and 12).

Figure 8:
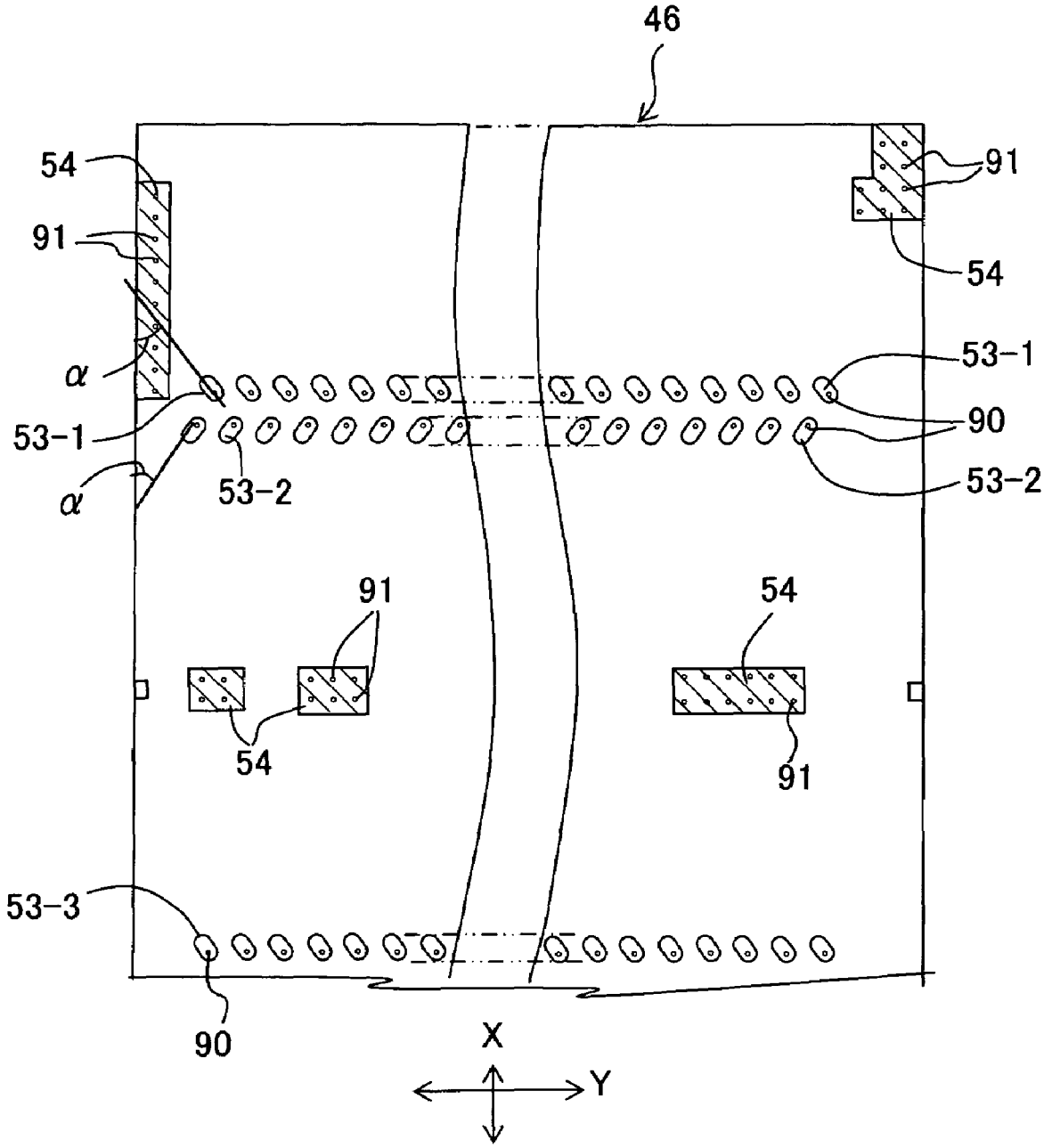
FIG. 8 is a partially cut-out, enlarged plan view showing patterns on the lower layer sheet of a restricting layer.

As shown in FIG. 8, the lower sheet 46 of the two sheets 46 and 47 as the restricting layer has first connecting patterns 53 (individually shown with the reference numerals 53-1, 53-2, and 53-3) formed on the upper surface of the lower sheet 46. The first connecting patterns 53 are substantially elliptic in a plan view. The first connecting patterns 53 are arranged at regular spacings so as to overlap with at least portions of the dummy individual electrodes 38-1, 38-2, and 38-3 on the piezoelectric sheets 34 in a plan view. The first connecting patterns 53 also extend obliquely at the angle $\alpha$ (acute angle of approximately 60 degrees) with respect to the short side (in the X direction) of the piezoelectric actuator 12 in a plan view. The lower sheet 46 also has communicating patterns 54 as common conductors formed at the four corners of its upper surface and between the arrays of patterns 53 on this surface. The communicating patterns 54 overlap in a plan view with portions of the common electrodes 37 on the piezoelectric sheets 34.

Figure 9:
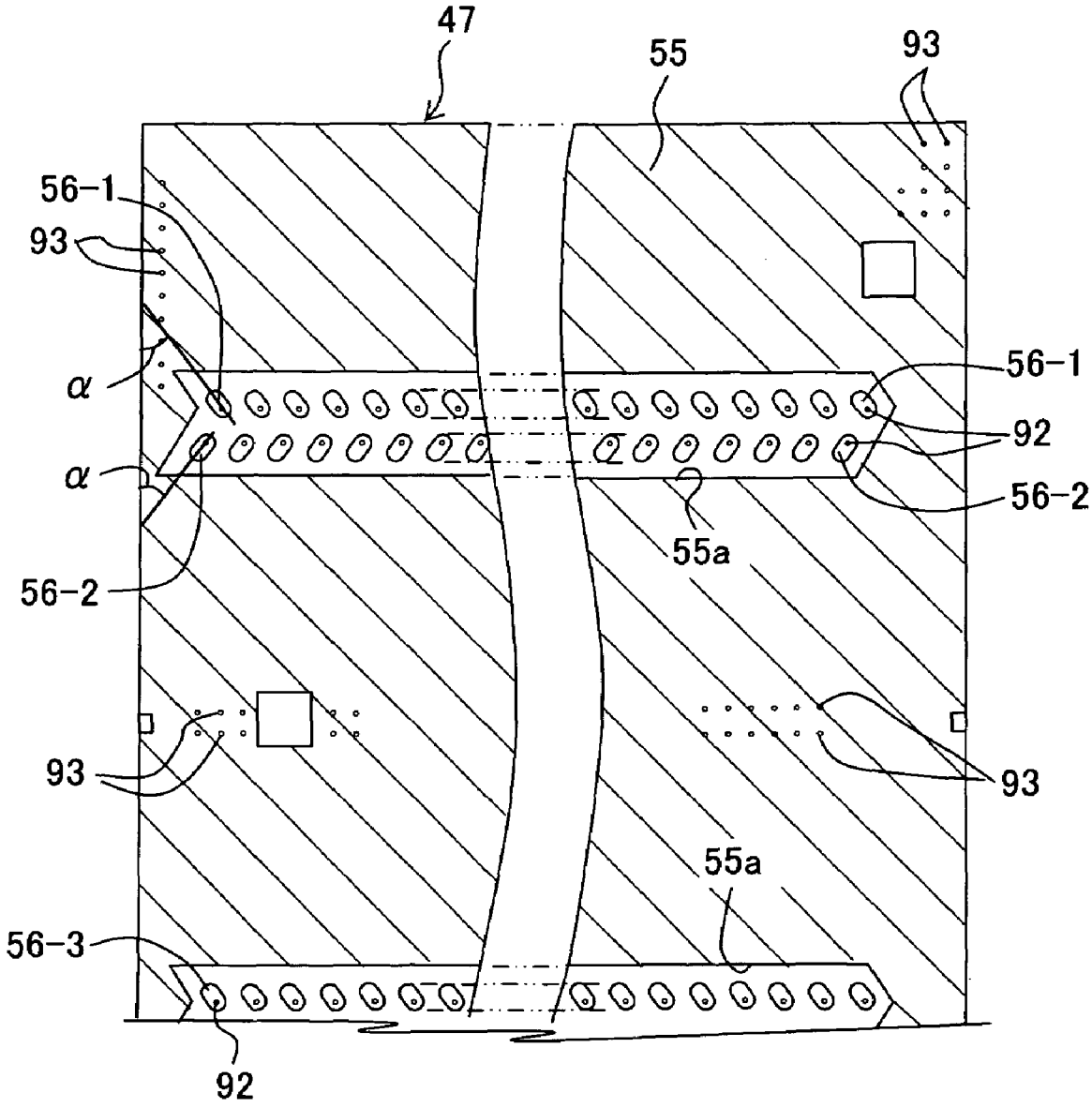
FIG. 9 is a partially cut-out, enlarged plan view showing patterns on the upper layer sheet of a restricting layer.

On the other hand, as shown in FIG. 9, the upper sheet 47 has a communicating pattern 55 as a common conductor and second connecting patterns 56 (individually shown with reference numerals 56-1, 56-2, and 56-3) formed on it. The communicating pattern 55 overlaps with the common electrode 37 on the piezoelectric sheets 34 with substantially the same size as that of the common electrode 37 in a plan view. The second connecting patterns 56 are arranged at regular spacings so as to overlap in a plan view with at least portions of the first connecting patterns 53 (individually shown with reference numerals 53-1, 53-2, and 53-3) on the lower sheet 46.

The second connecting patterns 56 are called second island-shaped individual conductors. In this embodiment, the second connecting patterns 56 are connected electrically to the dummy individual electrodes 38, which are the first island-shaped individual conductors, via the first connecting patterns 53 and internal conducting electrodes 90 and 92, which will be described later on. The internal conducting electrodes 90 and 92 extend through the piezoelectric sheets.

The second connecting patterns 56 also extend obliquely at the angle α (acute angle of approximately 60 degrees) with respect to the extending direction of the short side of the piezoelectric actuator 12 in a plan view (see FIGS. 9 and 13). The shortest distances between the contour edges of the pattern regions of the second connecting patterns 56 and linear contour edges 55*a* of the pattern regions of the communicating pattern 55, and the distances between the contour edges of the pattern regions of the adjoining second connecting patterns 56 are set to be constant.

In this way, by obliquely forming the second connecting patterns 56 as the second island-shaped individual conductors, it is possible to make them long, and while maintaining a constant distance between the contour edges of the adjoining pattern regions, it is possible to shorten the distance between the pair of opposite contour edges 55*a* (see FIG. 13). The result is that, even if there is a slight error in the size of the pattern regions (area) caused by the spreading of the contours of the patterns when printing the patterns, the distance between adjoining patterns can be maintained at a predetermined distance e2 or a longer distance than the predetermined distance. Therefore, when applying voltage to the electrodes, current does not leak between adjoining electrodes, and it is possible to reliably operate only the active portions corresponding to the predetermined pressure chambers. This achieves the result of maintaining good recording quality.

As a result, it is possible to shorten the short side of the piezoelectric actuator 12 (in the X direction) so as to make the ink-jet recording head compact.

Figure 10:
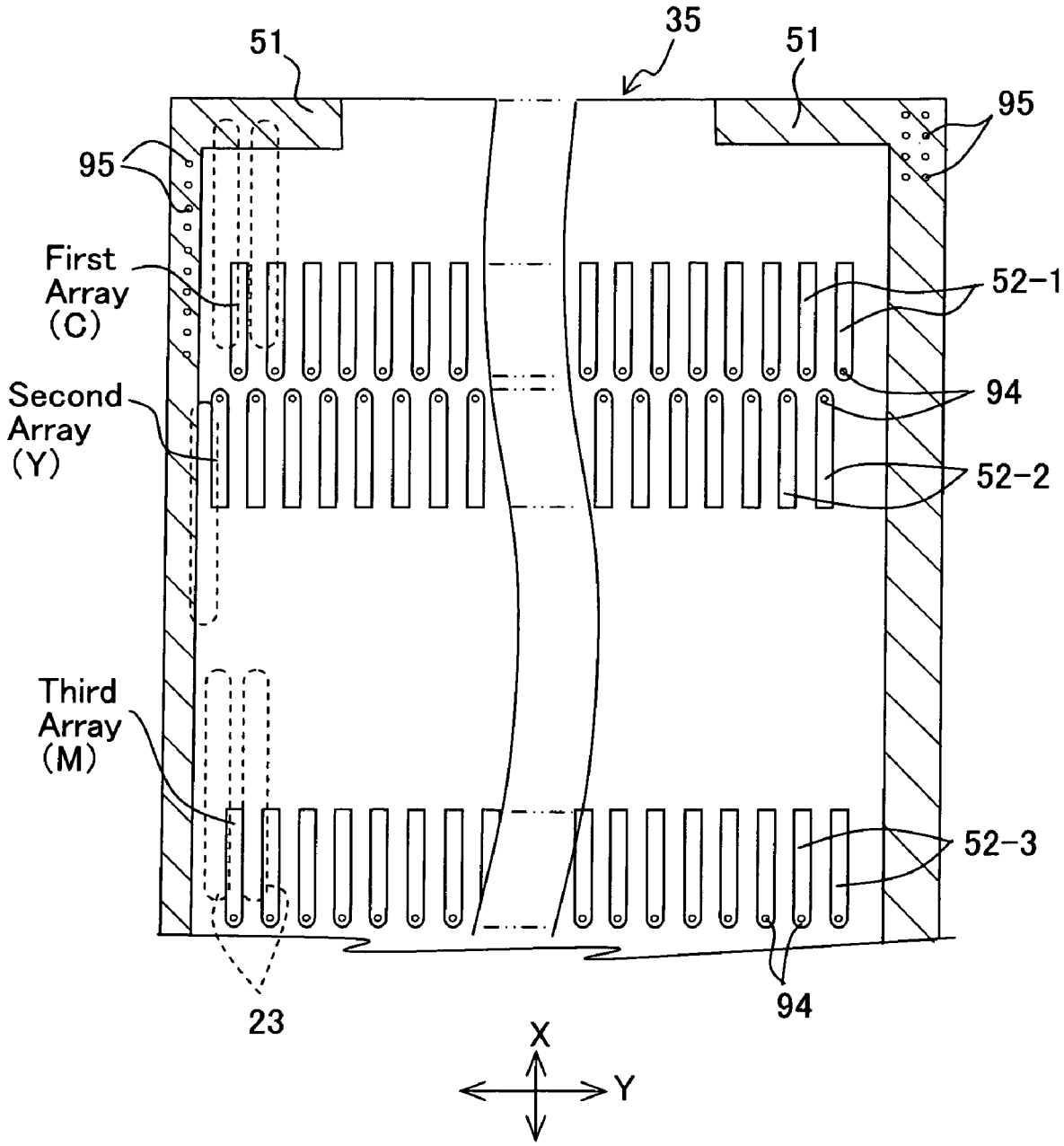
FIG. 10 is a partially cut-out, enlarged plan view showing patterns of individual conducting layers etc. on a top sheet.

As shown in FIGS. 10 and 13, the top sheet 35 as the surface sheet which is the uppermost layer of the piezoelectric actuator 12 has a common conducting layer 51 formed on its top surface. The common conducting layer 51 extends in the form of a band or the like along the portions near to the periphery of the top surface of the top sheet 35 so as to overlap in a plan view with a portion of the communicating pattern 55 on the top sheet 47. The top sheet 35 also has individual conducting layers 52 (individually shown with reference numerals 52-1, 52-2, 52-3) formed on its top surface. The individual conducting layers 52 are arranged at regular spacings so as to overlap in a plan view with the second connecting patterns 56-1, 56-2, and 56-3 on the upper sheet 47. As shown in FIG. 10, the individual conducting layers 52-1, 52-2, and 52-3 are substantially parallel to the short edges (in the X direction) of the top sheet 35, and consequently to the individual electrodes 36-1, 36-2, and 36-3. The individual conducting layers 52-1, 52-2, and 52-3 are linear and extending in the direction of the linear portions 36*b* of the individual electrodes 36-1, 36-2, and 36-3, but shorter than the linear portions 36*b*. As shown in FIG. 13, the individual conducting layers 52-1, 52-2, and 52-3 which are formed on the top surface of the top sheet 35 are positioned over the spacer walls 24 between the adjoining pressure chambers 23 which are positioned in parallel below the individual conducting layers 52-1, 52-2, and 52-3. In FIG. 13, the individual conducting layers 52-1, 52-2, and 52-3 are slightly offset from the centers of the spacer walls 24, but may be aligned with the centers.

Figure 11:
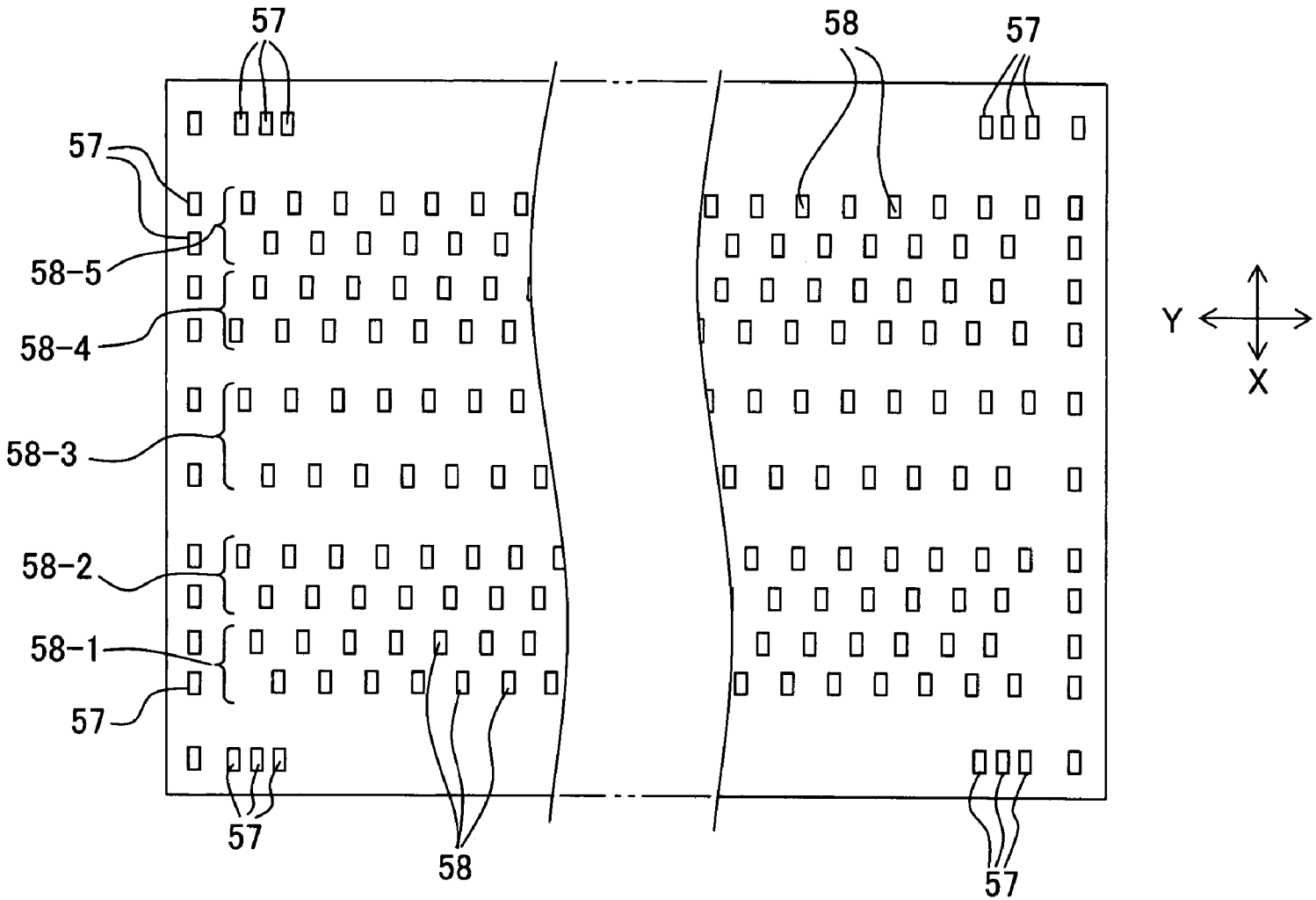
FIG. 11 is a partially cut-out, enlarged plan view showing patterns of individual surface electrodes etc. on the top sheet.

As shown in FIG. 11, the top sheet 35 further has individual surface electrodes 58 and common surface electrodes 57 formed on its top surface. These electrodes 58 and 57 are rectangular or elliptic in a plan view. These electrodes 58 and 57 are surface electrodes (electrodes which are formed later) for connecting with a common joining electrode 77 and individual joining electrodes 78, which are formed on the bottom surface of the flat cable 40, described later on. In this case, as shown in FIG. 13, the individual surface electrodes 58 are formed to take a form of islands to overlap only partially in a plan view with and be connected electrically to suitable portions in the longitudinal direction of the individual conducting layers 52-1, 52-2, and 52-3 on the top sheet 35. The individual surface electrodes 58 are arranged in a staggered manner in the X direction at the locations where they adjoin along the arrays of individual conducting layers 52-1, 52-2, and 52-3 (in the Y direction).

In other words, in the illustrated embodiment, each individual surface electrode 58 is offset by substantially a half of the arrangement pitch P in a plan view with respect to the associated pressure chamber 23 and consequently to the associated active portion. The individual surface electrodes 58 are arranged over the spacer walls 24 between the adjoining pressure chambers 23 (see FIG. 13).

As a modification of this embodiment, each of the individual surface electrodes 58, which are arranged over the spacer walls 24 between the adjoining pressure chambers 23, may be offset by 1.5 times of the arrangement pitch P in the Y direction with respect to the associated pressure chamber 23 (active portion).

The lower sheet 46 has a plurality of through holes cut through its thickness at the first connecting patterns 53-1, 53-2, and 53-3. The through holes are filled with conductive members (conductive paste), which form internal conducting electrodes 90 for connecting the first connecting patterns 53-1, 53-2, and 53-3 electrically in the vertical directions to the dummy individual electrodes 38-1, 38-2, and 38-3 on the piezoelectric sheet 34 adjoining the bottom surface of the lower sheet 46 (see FIGS. 4 and 8).

Likewise, the lower sheet 46 has a plurality of through holes cut through its thickness at the communicating patterns 54. The through holes are filled with conductive members, which form internal conducting electrodes 91 for connecting the communicating patterns 54 electrically in the vertical directions to the common electrode 37 on the piezoelectric sheet 34 adjoining the bottom surface of the lower sheet 46 (see FIG. 8).

Likewise, the upper sheet 47 has a plurality of through holes cut through its thickness. In some of the through holes, internal conducting electrodes 93 are formed to individually electrically connect the locations of the second connecting patterns 56-1, 56-2, and 56-3 and the locations of the first connecting patterns 53-1, 53-2, and 53-3 on the lower sheet 46. In the other through holes, internal conducting electrodes 93 are formed to electrically connect the communicating patterns 55 and 54. (See FIG. 9).

Likewise, the top sheet 35 has a plurality of through holes cut through its thickness. In some of the through holes, internal conducting electrodes 94 are formed to individually electrically connect the locations of the individual conducting layers 52-1, 52-2, and 52-3 and the second connecting patterns 56-1, 56-2, and 56-3 on the upper sheet 47, which adjoins the bottom surface of the top sheet 35. In the other through holes, internal conducting electrodes 95 are formed to electrically connect the common conducting layers 51 and the communicating patterns 55 on the upper sheet 47, which adjoins the bottom surface of the top sheet 35. (See FIG. 10).

If a plurality of sheets are stacked, it is preferable that the internal conducting electrodes 42*a*, 42*b*, 90, 92, and 94 for vertically connecting the individual electrodes 36 and the associated dummy individual electrodes 38, first connecting patterns 53 and second connecting patterns 56 on the vertically adjoining sheets be arranged in positions where they do not overlap in a plan view.

The common surface electrodes 57 are formed later in the form of islands so as to overlap in a plan view with portions of the common conducting layers 51, which are formed on the top surface of the top sheet 35. The later formation of the common surface electrodes 57 and individual surface electrodes 58 is performed by screen printing conductive members such as silver palladium.

As a wiring board for electric connection to the common surface electrodes 57 and individual surface electrodes 58, the structure for arranging the common joining electrode 77, individual joining electrodes 78 and wirings 79 on the flexible flat cable 40 will be described below with reference to FIGS. 11, 14 and 15. The wirings 79 connect the joining electrodes 77 and 78 to external elements.

Figure 14A:
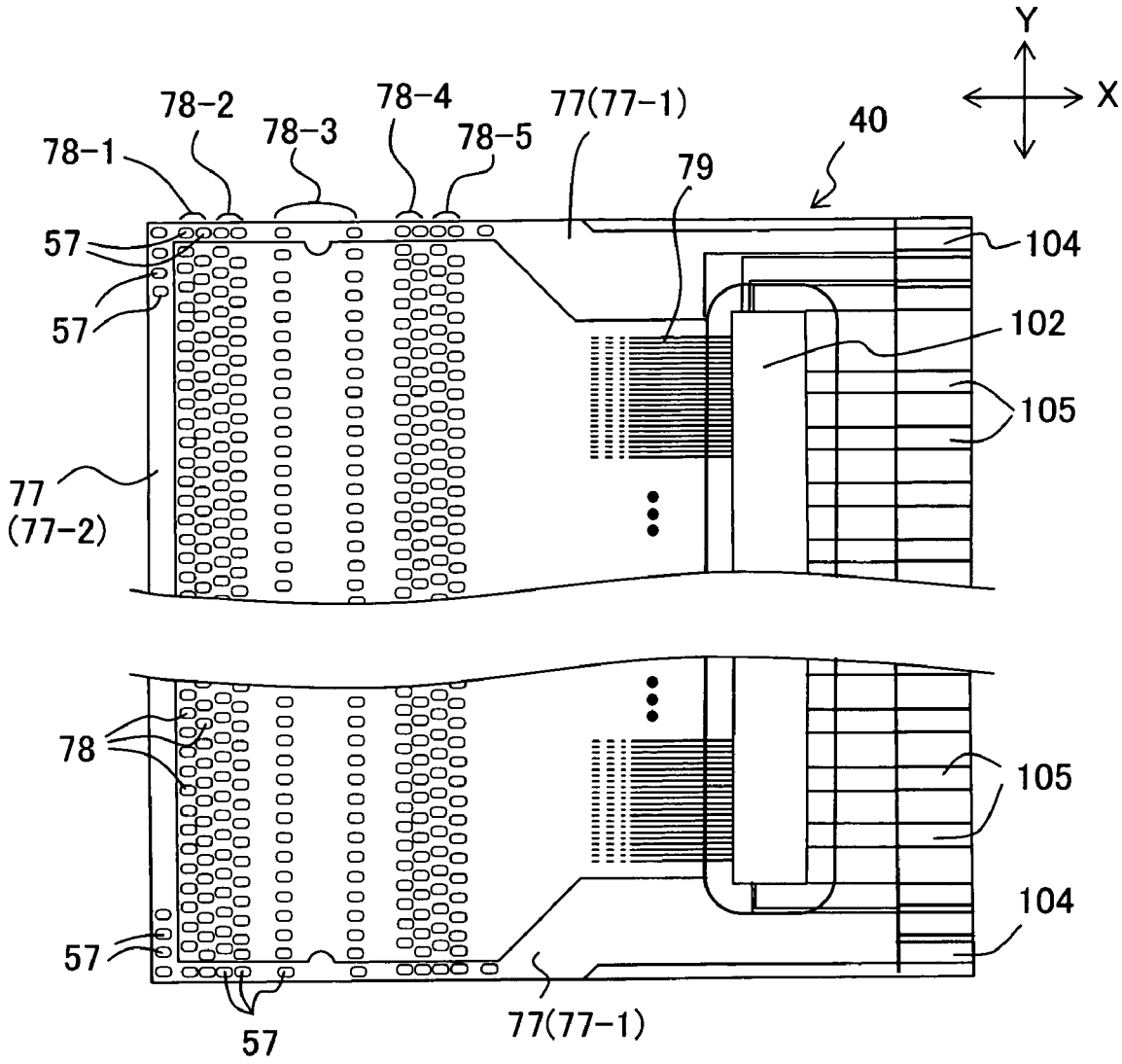
FIG. 14A is a schematic plan view showing the positional relationships among the common joining electrode, individual joining electrodes, wirings and an integrated circuit in a flexible flat cable.
Figure 14B:
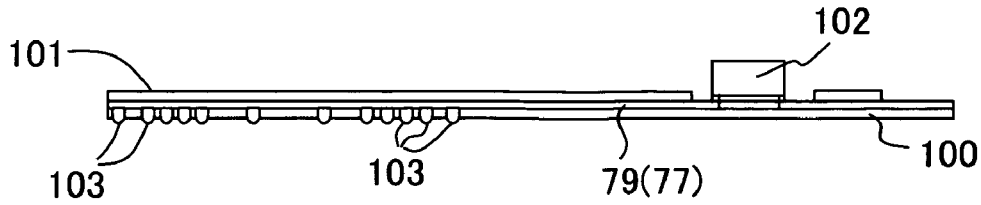
FIG. 14B is a side view thereof.

As shown in FIGS. 14A and 14B, the flexible flat cable 40 overlaps with the top surface of the top sheet 35 and protrudes outwardly in a direction (X direction) that is perpendicular to the nozzle arrays. The flexible flat cable 40 includes a belt-shaped or band-shaped base member 100, which is made of electrically insulating flexible synthetic resin (such as polyimide resin, polyester resin, or polyamide resin). The common joining electrode 77, individual joining electrodes 78, and fine wirings 79, which are made of copper foil, are formed with a photo resist method or the like on one surface of the base member 100. The surfaces of these constituents are covered by a cover lay 101, which is made of electrically insulating flexible synthetic resin (such as polyimide resin, polyester resin, or polyamide resin). The other ends of the wirings 79 are electrically connected to a driving integrated circuit 102, which is mounted on the base member 100. The integrated circuit 102 is connected to the terminals 105 on the other end of the flexible flat cable 40. The base member 100 has holes (openings) formed in locations corresponding to the island-shaped individual joining electrodes 78, and to the locations for arrangement of the common surface electrodes 57 of the band-shaped common joining electrode 77. Bump electrodes 103 are fixed in the positions of those orifices (openings). (See FIG. 14B).

On the top surface of the piezoelectric actuator 20, as shown in FIG. 11, the common surface electrodes 57 are formed at suitable spacings in the first direction (Y direction) and the second direction (X direction), which is perpendicular thereto, at positions near to the periphery of the broad-width surface of the top sheet 35. The individual surface electrodes 58 are arranged in a staggered manner in two arrays in the Y direction for each of the first nozzle array N1, second nozzle array N2, third nozzle array N3, fourth nozzle array N4 and fifth nozzle array N5, and for each of the five arrays of pressure chambers 23-1, 23-2, 23-3, 23-4 and 23-5, which are associated with the nozzle arrays N1, N2, N3, N4 and N5, respectively. In FIG. 11, the individual surface electrodes 58 are shown as a first group 58-1, a second group 58-2, a third group 58-3, a fourth group 58-4 and a fifth group 58-5, which are associated with the first array 23-1, second array 23-2, third array 23-3, fourth array 23-4 and fifth array 23-5 of pressure chambers, respectively.

On the flexible flat cable 40, as shown in FIG. 14, the common joining electrode 77 includes at least two band-shaped first common joining electrode portions 77-1, which are formed along the opposing side edges extending in the second direction (X direction, along the short side of the actuator). In this embodiment, the common joining electrode 77 also includes a band-shaped second common joining electrode portion 77-2, which is formed along a side edge extending in the first direction (Y direction, a direction of the long side of the actuator). Both ends of the second common joining electrode portion 77-2 are electrically connected to the leading ends of the first common joining electrode portions 77-1. FIG. 14 shows the positions where the common surface electrodes 57 are arranged and the bump electrodes 103, each of which is associated with one of the surface common electrodes 57. This shows how these electrodes 57 and 103 are overlapped with the first common joining electrode portions 77-1 and the second common joining electrode portion 77-2. The other ends of the two first common joining electrode portions 77-1 are electrically connected to the connecting terminals 104 on the other end of the flexible flat cable 40.

On the other hand, the individual joining electrodes 78 are arranged in a staggered manner in the first direction (Y direction) to face the first array 23-1, second array 23-2, third array 23-3, fourth array 23-4 and fifth array 23-5 of pressure chambers, and consequently to the arrays of individual surface electrodes 58, which are associated with the arrays 23-1, 23-2, 23-3, 23-4 and 23-5 of pressure chambers, respectively. In FIGS. 14A and 15, the individual joining electrodes 78 are shown as a first group 78-1, a second group 78-2, a third group 78-3, a fourth group 78-4 and a fifth group 78-5, which are associated with the first array 23-1, second array 23-2, third array 23-3, fourth array 23-4 and fifth array 23-5 of pressure chambers, respectively.

The individual joining electrodes 78 in each array are equal in number (=75 in this embodiment) to the nozzles in each array. For example, in FIG. 15, the individual joining electrodes 78 in the first group 78-1 are arranged in the positions indicated by the numbers [002], [007], [102], [107], . . . [362], and [367]. Likewise, the individual joining electrodes 78 in the second group 78-2 are represented by the numbers [003], [008], [103], [108], . . . [363], and [368]. Likewise, the individual joining electrodes 78 in the third group 78-3 are represented by the numbers [001], [006], [101], [106], . . . [361], and [366]. Likewise, the individual joining electrodes 78 in the fourth group 78-4 are represented by the numbers [000], [005], [100], [105], . . . [360], and [365]. Likewise, the individual joining electrodes 78 in the fifth group 78-5 are represented by the numbers [004], [009], [104], [109], . . . [364], and [369]. Thus, the individual joining electrodes 78 are arranged in ten arrays that extend in the first direction (Y direction) and that are spaced at suitable spacings in the X direction. As an example, the individual joining electrodes 78 in the first array are represented by the numbers [002], [012], [022] . . . [362]. As another example, the individual joining electrodes 78 in the second array are represented by the numbers [007], [017], [027] . . . [367]. As still another example, the individual joining electrodes 78 in the tenth array are represented by the numbers of [009], [019], [029] . . . [369].

The odd and even numbered arrays of individual joining electrodes 78 in each group are arranged in a staggered manner. For example, the individual joining electrodes 78 of the first and second arrays are staggered.

The individual joining electrodes of the seventh and eighth arrays are arranged in the same positions (in other words the same rows) in the Y direction for the individual joining electrodes of the first and second arrays. The individual joining electrodes of the third and fourth arrays, the fifth and sixth arrays, and the ninth and tenth arrays are offset by half of a pitch in the Y direction (in other words, the individual joining electrodes of each array are positioned between the individual joining electrodes of the first and second arrays in the Y direction). The individual joining electrode of the third and fourth arrays, the fifth and sixth arrays, and the ninth and tenth arrays are mutually aligned in the same rows.

Figure 15:
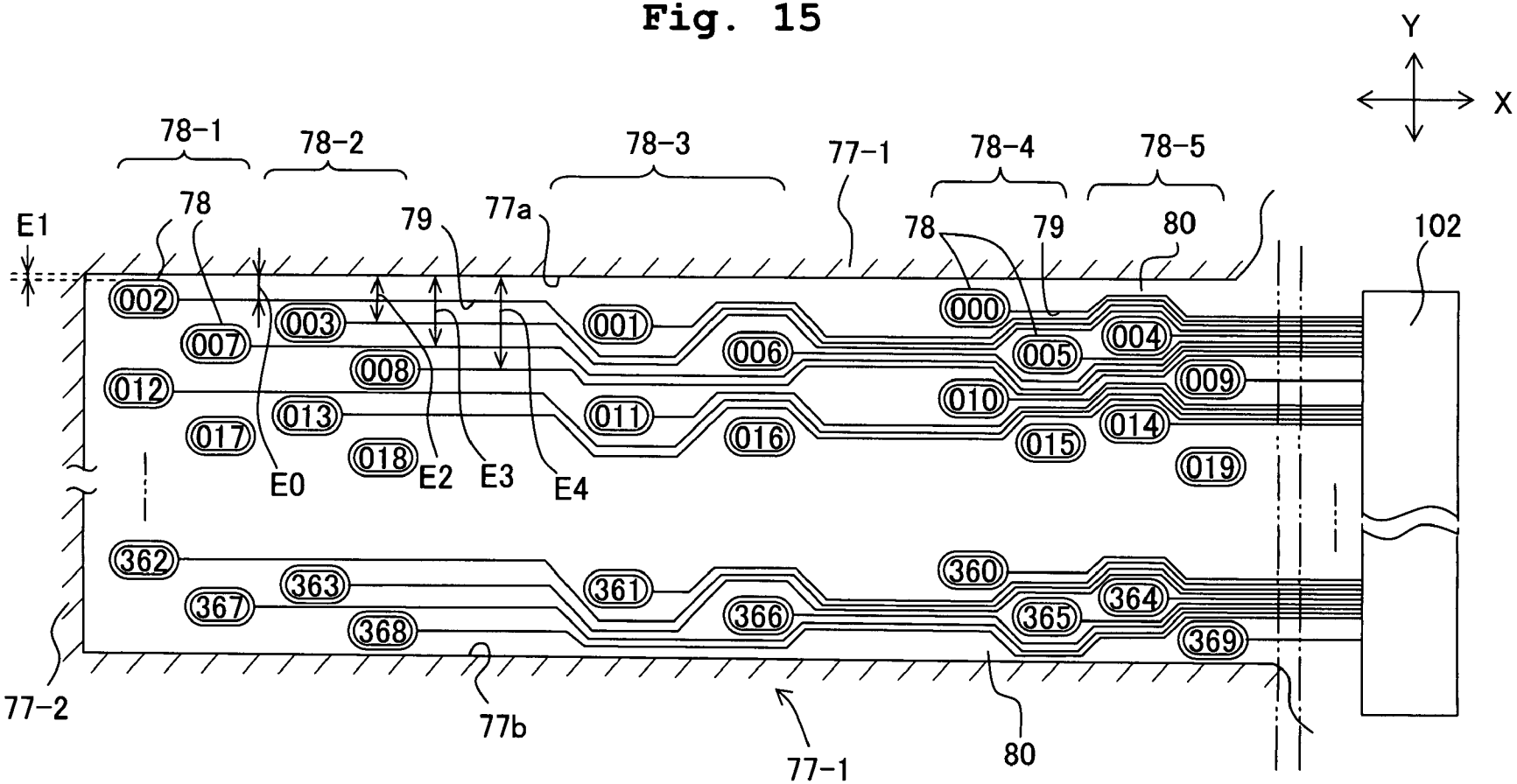
FIG. 15 is an enlarged partial plan view showing the arrangement of the common joining electrode, individual joining electrodes and wirings in the flexible flat cable.

The numbers [000], [001] . . . applied to the individual joining electrodes in FIG. 15 indicate the order from one end of the output terminals of the driving integrated circuit 102 to which these electrodes are connected. Since there are ten arrays of individual joining electrodes, the formation patterns of the wirings 79 which connect these electrodes and the output terminals are repetitions of a group of individual joining electrodes assigned with numbers from [000] to [009], up to [369].

In this embodiment, as shown in FIG. 15, the individual joining electrode 78 numbered [000] in the seventh array and the individual joining electrode 78 numbered [002] in the first array are arranged nearest to the side edge 77*a* in the second direction (X direction) of one of the first common joining electrode portions 77-1. Therefore, if an imaginary line which is parallel to the side edge 77*a* is set to pass through the center of the thickness in the Y direction of the individual joining electrode 78 numbered [000] or [002], the distance E0 between the side edge 77*a* and the parallel imaginary line is defined as one level difference. Likewise, the individual joining electrode 78 numbered [368] in the fourth array and the individual joining electrode 78 numbered [369] in the tenth array are arranged nearest the side edge 77*b* in the second direction (X direction) of the other first common joining electrode portion 77-1. Therefore, the distance E0 between the side edge 77*b* and an imaginary line that passes through the center of the thickness in the Y direction of the individual joining electrode 78 numbered [368] or [369] is one level difference.

The individual joining electrode 78 numbered [003] in the third array, the individual joining electrode 78 numbered [001] in the fifth array, and the individual joining electrode 78 numbered [004] in the ninth array are arranged so that the distance E2 between the side edge 77*a* and an imaginary line that passes through the center of the thickness in the Y direction of these individual joining electrodes 78 is two level differences (a spacing dimension of substantially 2×E0).

Likewise, the individual joining electrode 78 numbered [007] in the second array, the individual joining electrode 78 numbered [006] in the sixth array, and the individual joining electrode 78 numbered [005] in the eighth array are arranged so that the distance E3 between the side edge 77*a* and an imaginary line that passes through the center of the thickness in the Y direction of these individual joining electrodes 78 is three level differences (a spacing dimension of substantially 3×E0). Likewise, the individual joining electrode 78 numbered [008] in the fourth array and the individual joining electorate 78 numbered [009] in the tenth array are arranged so that the distance E4 between the side edge 77*a* and an imaginary line that passes through the center of the thickness in the Y direction of these individual joining electrodes 78 is four level differences (a spacing dimension of substantially 4×E0).

In this case, the gap E1 between the side edge 77*a* and each of the individual joining electrodes 78 that are nearest thereto is smaller than the gap E2 between the side edge 77*a* and the side edge of each of the individual joining electrodes 78 positioned at the ends of the other groups, for example, the individual joining electrodes 78 numbered [003], [001], and [004]. The dimensional relationship among the gaps is E2>E0>E1. (See FIG. 15).

The wirings 79 connected to the individual joining electrodes 78 in all arrays form a wiring pattern which extends along the side edge 77*a* extending in the second direction (X direction) of the first common joining electrode portions 77-1. The routes of the wirings 79 are determined by combinations of straight lines or combinations of straight and bent lines so as to be arranged between the side edge 77*a* and the individual joining electrodes 78, and between the individual joining electrodes 78.

The wirings 79 connected to the individual joining electrodes 78 nearest to the side edge 77*a* of the band-shaped common joining electrode 77 are passed between the side edge 77*a* and individual joining electrodes 78 in another array (group) which are positioned farther away from the side edge 77*a* than the nearest individual joining electrodes 78. These wirings 79 are formed (arranged) in positions where a gap 80 between the side edge 77*a* and the wirings 79 is nearly equal to or larger than the gap E1 between the side edge 77*a* and the individual joining electrodes 78. For example, in the case where the wiring 79 connected to the individual joining electrode 78 numbered [000] in the fourth group 78-4 passes through the gap between the side edge 77*a* and one of the individual joining electrodes 78 in another group (array), for example, the gap 80 between the side edge 77*a* and the individual joining electrode 78 numbered [004] in the fifth group 78-5, the gap between this wiring 79 and the side edge 77*a* is set to be equal to or larger than the gap E1.

In the embodiment shown in FIG. 15, there is a gap of two level differences between the side edge 77*a* and the individual joining electrode 78 numbered [004] in the ninth array, so the intermediate portions of four wirings 79 connected to the individual joining electrode 78 numbered [002] in the first array, the individual joining electrode 78 numbered [003] in the third array, the individual joining electrode 78 numbered [001] in the fifth array, and the individual joining electrode 78 numbered [000] in the seventh array, respectively, which are positioned farther from the integrated circuit 102 than the individual joining electrode 78 numbered [004], pass through this gap of two level differences. The gap between the side edge 77*a* and even the one of these four wirings 79 which is closest to the side edge 77*a* (the wiring 79 connected to the individual joining electrode 78 numbered [000] in the fourth group) is nearly equal to or larger than the gap E1.

Between an individual joining electrode 78 at one end of one array and an individual joining electrode 78 at one end of another array adjacent to the one array in the extending direction of the wiring connected to the one array, a space or gap is formed so that a wiring connected to an individual joining electrode in another array passes through the gap. This gap is set so as to be distanced by two or more level differences of the three level differences. In the embodiment shown in FIG. 15, for example, the gap between the staggered individual joining electrodes 78 numbered [000] and [005] in the seventh and eighth arrays, respectively, is two level differences in the Y-direction. This gap is wide enough for the three wirings 79 connected to the individual joining electrodes 78 (numbered [002], [003] and [001]) at the adjacent ends of other arrays, namely the first, second and third arrays, to pass in an oblique direction through the gap. With this configuration, even if the gap in the second direction (X direction) between the staggered adjoining individual joining electrodes 78 in the odd and even numbered arrays of each group is small, the gap between them in the Y direction that is set to have two level differences enables the three wirings 79 to be arranged without approaching each other too excessively.

In addition, there are three or more arrays of individual joining electrodes 78, and the gap between the side edge 77*a* of the common joining electrode 77 and each of the individual joining electrodes 78 positioned at the adjacent ends of these arrays is set at three or more level differences. The second array of individual joining electrodes 78 adjoins the first array of individual joining electrodes 78 in the direction in which the wiring 79 connected to the individual joining electrode 78 at the end of the first array extends, and the gap between the individual joining electrode 78 at the end of the first array and the individual joining electrode 78 at the end of the second array is two or more level differences of three level differences. The third array of individual joining electrodes 78 adjoins the second array of individual joining electrodes 78 in the direction in which the wiring 79 connected to the individual joining electrode 78 at the end of the second array extends, and the individual electrode 78 at the end of the third array is positioned in the gap of two or more level differences between the individual electrodes 78 at the ends of the first and second arrays. In this embodiment, while the gap in the Y direction between the staggered individual joining electrodes 78 numbered [000] and [005] in the seventh and eighth arrays, respectively, is set at two level differences, the individual joining electrode 78 numbered [004] in the ninth array is positioned in the gap in the Y direction between the individual joining electrodes 78 numbered [000] and [005] in the seventh and eighth arrays, respectively. With this configuration, it is possible to make the wiring density fine without excessively narrowing the gaps between the adjoining wirings 79 and the gaps between the side edge 77*a* of the common joining electrode 77 and the wirings 79 in locations where wirings 79 are mingled (where there is high density of arrangement, between the individual joining electrodes 78 in the seventh to tenth arrays, which are near to the integrated circuit 102 in the X direction).

The driving integrated circuit 102 converts the recording data transferred in serial form from an external device (the control board in or on the main body of the recording apparatus) into parallel data, each of which is associated with one of the nozzles, generates waveform signals of a predetermined voltage corresponding to the recording data, and outputs the generated signals to the respective wirings 79. The connection between the integrated circuit 102 and the actuator 12 involves high density formation of wirings 79 as described above, which are equal in number to the nozzles. However, between the integrated circuit 102 and the control board, because the recording data are serially transferred, a low density wiring pattern is acceptable.

The flexible flat cable 40 includes a flexible, electrically insulating synthetic resin member (base member 100) which can withstand bending deformation. The fine-width wirings 79 which are made of copper foil or other conducting material and formed on one side of the synthetic resin member. The wirings 79 are covered by a cover lay 101 made of flexible, electrically insulating synthetic resin. Only the associated portions of the common joining electrode 77 and portions of the individual joining electrodes 78 are opened on one of the broad-width surfaces (which is adjacent to the base material 100) of the flexible flat cable 40. The bump electrodes 103 are formed in these openings. When the bump electrodes 103 are made of solder, they are overlapped on the common surface electrodes 57 and the individual surface electrodes 58, and joined thereto by being heated and pressed. For a bump electrode of the type made of anisotropic conductive resin or the like, which is conductive when pressurized, simple pressure junction is acceptable, which improves the joining of the flexible flat cable 40.

In the embodiment described above, there are five arrays of nozzles and ten arrays of staggered individual joining electrodes 78, but the present invention can be applied to three or more arrays of individual joining electrodes 78.

The common surface electrodes 57 and the individual surface electrodes 58 are arranged in symmetry around the central point of the broad-width surface of the piezoelectric actuator 12. Alternatively, the common joining electrode 77 and individual joining electrodes 78 formed on the broad-width surface of the flexible flat cable 40, which is a wiring board, may be so arranged that the flexible flat cable 40 can be electrically connected to the common surface electrodes 57 and the individual surface electrodes 58 when the flexible flat cable 40 is moved by 180 degrees around the center of symmetry. This makes it extremely easy to reverse the direction in which the flexible flat cable 40 is pulled out, by rotating the cable by 180 degrees, using the same head unit.

What is claimed is:

1. A head for ink-jet recording comprising:

a plurality of nozzle arrays each of which is arranged along a first direction and has a plurality of nozzles;

a plurality of pressure chambers corresponding to the nozzles respectively;

an actuator having a plurality of energy generating devices each of which selectively provides a discharge energy to an ink contained in each of the pressure chambers; and a wiring substrate having wirings each of which feeds electricity to each of the energy generating devices;

wherein a plurality of arrays of individual surface electrodes and a common surface electrode are provided in a form of plane on the actuator, the plurality of arrays of individual surface electrodes being provided to correspond to the nozzle arrays respectively, each of the arrays having the individual surface electrodes connected to the energy generating devices respectively and arranged in a staggered manner along the first direction, and the common surface electrode being commonly connected to the plurality of energy generating devices;

wherein a plurality of arrays of individual joining electrodes and a common joining electrode are formed in the wiring substrate, the plurality of arrays of individual joining electrodes being provided to correspond to the plurality of individual surface electrodes of the actuator respectively, each of the arrays of individual joining electrodes having a plurality of individual joining electrodes arranged in a staggered manner along the first direction, each of the plurality of individual joining electrodes being joined to an associated individual surface electrode of the individual surface electrodes, the common joining electrode being joined to the common surface electrode at a position opposed to the common surface electrode;

wherein the common joining electrode of the wiring substrate is formed in a band-like manner and extends in a direction substantially perpendicular to a direction of the arrays of individual surface electrodes;

wherein the wirings connected to the individual joining electrodes respectively extend substantially parallel to a side edge of the common joining electrode; and wherein a wiring of the wirings of the wiring substrate is connected to an individual joining electrode which belongs to the individual joining electrodes of the wiring substrate, and is positioned in a nearest array to the side edge of the common joining electrode among the arrays of individual surface electrodes, and the wiring is formed so that: the wiring passes between the side edge and another individual joining electrode which is located in another array from the nearest array and is located at a position farther from the side edge than the individual joining electrode; and a gap between the wiring and the side edge is substantially equal to or greater than a gap between the individual joining electrode and the side edge.

2. The head for ink-jet recording according to claim 1, wherein when a number of arrays of the plurality of arrays of individual joining electrodes is not less than 3, and a minimum value of a distance between the individual joining electrodes in the first direction is L, a spacing between an individual joining electrode of a first array of the arrays of individual joining electrodes and an individual joining electrode of a second array, which is adjacent to the individual joining electrode of the first array in an extending direction of a wiring connected to the individual joining electrode of the first array, is distanced by a length of not less than 2L in the first direction so that a wiring, which is connected to an individual joining electrode of other array, passes through the spacing.

3. The head for ink-jet recording according to claim 1, wherein when a number of arrays of the individual joining electrodes is not less than 3, and a minimum value of a distance between the individual joining electrodes in the first direction is L, a spacing between an individual joining electrode of a first array of the arrays of individual joining electrodes and an individual joining electrode of a second array adjacent to the individual joining electrode of the first array in an extending direction of a wiring, which is connected to the individual joining electrode of the first array, has a length of not less than 2L in the first direction; and an individual joining electrode of a third array, which is adjacent to the individual joining electrode of the second array in an extending direction of a wiring connected to the individual joining electrode of the second array, is arranged in the first direction between the individual joining electrode of the first array and the individual joining electrode of the second array.

4. The head for ink-jet recording according to claim 1, wherein the wiring board is a flexible flat cable extending in a direction substantially perpendicular to the nozzle arrays, and the common joining electrode is formed along an edge portion of the flexible flat cable extending along a direction substantially perpendicular to the first direction.

5. The head for ink-jet recording according to claim 4, wherein the flexible flat cable has an intermediate portion in an extending direction thereof; an integrated circuit for driving the energy generating devices is mounted on the intermediate portion; and other end of each of the wirings is connected to the integrated circuit.

6. The head for ink-jet recording according to claim 4, wherein:

the flexible flat cable is provided with a substrate which has the common joining electrode, the individual joining electrodes and the wirings on one surface thereof; and the common joining electrode and the individual joining electrodes are exposed via opening portions formed in the substrate respectively.

7. The head for ink-jet recording according to claim 6, wherein bump electrodes are disposed on surfaces of the common joining electrode and the individual joining electrodes which are exposed in the opening portions respectively to laminate and join the common surface electrode and the individual surface electrodes with each other.

8. A head for ink-jet recording comprising:

a plurality of nozzle arrays arranged along a first direction, each of the nozzle arrays having a plurality of nozzles;

a plurality of pressure chambers corresponding to and communicating with the plurality of nozzles respectively;

actuators which are provided for the plurality of pressure chambers respectively and which selectively deform the pressure chambers in order to jet an ink from the nozzles;

a wiring substrate having wirings electrically connected to the actuators;

a plurality of arrays of individual electrodes which are arranged on the wiring substrate and correspond to the plurality of nozzle arrays respectively, each of the arrays of individual electrodes having a plurality of individual electrodes which are arranged along the first direction in a staggered manner and which feed electricity to portions of the actuators corresponding to the pressure chambers; and a common electrode arranged on the wiring substrate and extends in a second direction which is substantially perpendicular to the first direction;

wherein a spacing between the common electrode and a wiring of the wirings which is connected to a nearest individual electrode nearest to the common electrode among the plurality of individual electrodes of the wiring substrate is greater than a spacing between the common electrode and the nearest individual electrode.

9. An ink-jet recording apparatus comprising:

a head for ink-jet recording;

an ink tank which supplies an ink to the head for ink-jet recording, wherein the head for ink-jet recording includes:

a plurality of nozzle arrays arranged along a first direction, each of the nozzle arrays having a plurality of nozzles;

a plurality of pressure chambers corresponding to and communicating with the nozzles respectively;

actuators which are provided for the pressure chambers respectively and which selectively deform the pressure chambers in order to jet an ink from the nozzles, a wiring substrate having wirings electrically connected to the actuators respectively;

a plurality of arrays of individual electrodes which are arranged on the wiring substrate and correspond to the nozzle arrays respectively, each of the arrays of individual electrodes having a plurality of individual electrodes which are arranged along the first direction in a staggered manner and which feed electricity to portions of the actuators corresponding to the pressure chambers; and a common electrode arranged on the wiring substrate and extends in a second direction substantially perpendicular to the first direction;

wherein a spacing between the common electrode and a wiring of the wirings connected to a nearest individual electrode nearest to the common electrode among the plurality of individual electrodes of the wiring substrate is greater than a spacing between the common electrode and the nearest individual electrode.

* * * * *